US008215743B2

(12) United States Patent
Takei et al.

(10) Patent No.: US 8,215,743 B2
(45) Date of Patent: Jul. 10, 2012

(54) RECORDING APPARATUS AND NON-TRANSITORY COMPUTER-READABLE RECORDING MEDIUM STORING A RECORDING PROGRAM

(75) Inventors: Kazushi Takei, Tokyo (JP); Hiroshi Takahashi, Kanagawa (JP); Masato Kobayashi, Kanagawa (JP); Tomonori Kimura, Kanagawa (JP); Yuichi Sakurada, Kanagawa (JP); Arata Suzuki, Kanagawa (JP); Nobuyuki Satoh, Kanagawa (JP); Yasuo Sakurai, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 200 days.

(21) Appl. No.: 12/805,076

(22) Filed: Jul. 12, 2010

(65) Prior Publication Data

US 2011/0007112 A1 Jan. 13, 2011

(30) Foreign Application Priority Data

Jul. 10, 2009 (JP) ..... 2009-163813
Jun. 21, 2010 (JP) ..... 2010-140739

(51) Int. Cl.
*B41J 29/393* (2006.01)

(52) U.S. Cl. ..... 347/19; 347/14; 347/9

(58) Field of Classification Search ..... 347/19, 347/14, 9
See application file for complete search history.

(56) References Cited

U.S. PATENT DOCUMENTS 7,841,682 B2 * 11/2010 Yorimoto et al. ..... 347/14
2009/0316164 A1 * 12/2009 Takahashi et al. ..... 358/1.8

FOREIGN PATENT DOCUMENTS

JP 2004-358759 A 12/2004

* cited by examiner

*Primary Examiner* — Matthew Luu
*Assistant Examiner* — Henok Legesse
(74) *Attorney, Agent, or Firm* — Harness, Dickey & Pierce, P.L.C.

(57) ABSTRACT

A recording apparatus includes a carriage; a first head group including a recording head and disposed on the carriage; and a second head group including a recording head and disposed on the carriage adjacent the first head group in a staggered manner with respect to a sub-scan direction. The carriage is configured to move in a main scan direction in order to record an image on a recording medium. The recording apparatus further includes a forming unit configured to form plural test patterns including a first pattern formed by the recording head of the first head group and a second pattern formed by the recording head of the second head group. The test patterns are spaced apart from one another in the sub-scan direction. The position of the second pattern relative to the first pattern in the sub-scan direction is varied successively from one test pattern to another.

9 Claims, 18 Drawing Sheets

3-LINE ERROR

2-LINE ERROR

1-LINE ERROR

NO POSITION ERROR

1-LINE ERROR

2-LINE ERROR

3-LINE ERROR

RECORDING APPARATUS AND NON-TRANSITORY COMPUTER-READABLE RECORDING MEDIUM STORING A RECORDING PROGRAM

BACKGROUND OF THE INVENTION

1. Field of the Invention

The present invention generally relates to recording apparatuses, such as inkjet printers, and computer-readable recording media storing recording programs.

2. Description of the Related Art

Typically, an inkjet recording apparatus includes a carriage on which a recording head is mounted. The recording head is configured to discharge droplets of ink onto a recording medium, such as a sheet of paper, as the carriage is moved in a main scan direction. The ink droplets attach onto the recording medium, thereby forming a line of an image thereon. The recording medium is then transported in a sub-scan direction perpendicular to the main-scan direction using a transport roller and the like, and another line of the image is formed. This process is repeated to form the desired image on the recording medium.

In order to increase the speed of such an image forming process, it is preferable to employ a recording head that is extended in the sub-scan direction so that a large number of dots can be printed simultaneously along the sub-scan direction. However, such a recording head having an extended length in the sub-scan direction requires increased cost and is also technically difficult to realize. One method attempts to overcome this problem by installing multiple recording heads in a staggered manner so as to form a recording head unit that is virtually extended in the sub-scan direction, thus increasing the number of dots that can be printed simultaneously in the sub-scan direction.

However, when the multiple recording heads are arranged in a staggered manner, the position of the individual recording heads may be shifted from their ideal positions according to design ("normal positions") depending on the location of the recording heads (including mechanically accuracy), the environment in which the recording heads are used, and the period of use of the recording heads, for example. The shift in the position of the recording heads from the normal position may cause a printing position error, resulting in an image break, density irregularities, and so on. Thus, when multiple recording heads are disposed in a staggered manner along the main-scan direction, it is important to provide a mechanism for preventing a printing position error in the sub-scan direction caused by the recording heads.

Japanese Laid-Open Patent Application No. 2004-358759 discusses a technique for accurately correcting a print position error between dots printed at different times. This technique involves printing a reference pattern and a correction pattern using plural nozzles of a recording head. Each pattern consists of dots printed on a printing medium, such as a sheet of paper, at certain intervals in the sub-scan and the main scan directions so that one or more columns of the dot patterns are printed at equal intervals along the main-scan direction. The technique is described as being capable of accurately controlling a print position error based on the reference pattern and the correction pattern.

However, the above technique does not take into consideration how to detect a printing position error in the sub-scan direction that is caused when plural recording heads are arranged in a staggered manner.

SUMMARY OF THE INVENTION

In one aspect of the present invention, a recording apparatus includes a carriage; a first head group including a recording head and disposed on the carriage; and a second head group including a recording head and disposed on the carriage adjacent the first head group in a staggered manner with respect to a sub-scan direction. The carriage is configured to move in a main scan direction in order to record an image on a recording medium. The recording apparatus further includes a forming unit configured to form a plurality of test patterns including a first pattern formed by the recording head of the first head group and a second pattern formed by the recording head of the second head group. The test patterns are spaced apart from one another in the sub-scan direction, and a position of the second pattern relative to a position of the first pattern in the sub-scan direction is varied successively from one test pattern to another.

In another aspect, the present invention provides a computer-readable recording medium storing a recording program which, when executed by a computer, causes a recording apparatus including a first head group and a second head group disposed on a carrier in a staggered manner with respect to a sub-scan direction to perform the steps of forming a first pattern using a recording head of the first head group; forming a second pattern using a recording head of the second head group at a position spaced apart from the first pattern in the sub-scan direction; forming pairs of the first pattern and the second pattern at intervals in the sub-scan direction; and varying the position of the second pattern relative to a position of the first pattern from one test pattern to another in the sub-scan direction.

DETAILED DESCRIPTION OF THE PREFERRED EMBODIMENTS

Recording Apparatus

Figure 1:
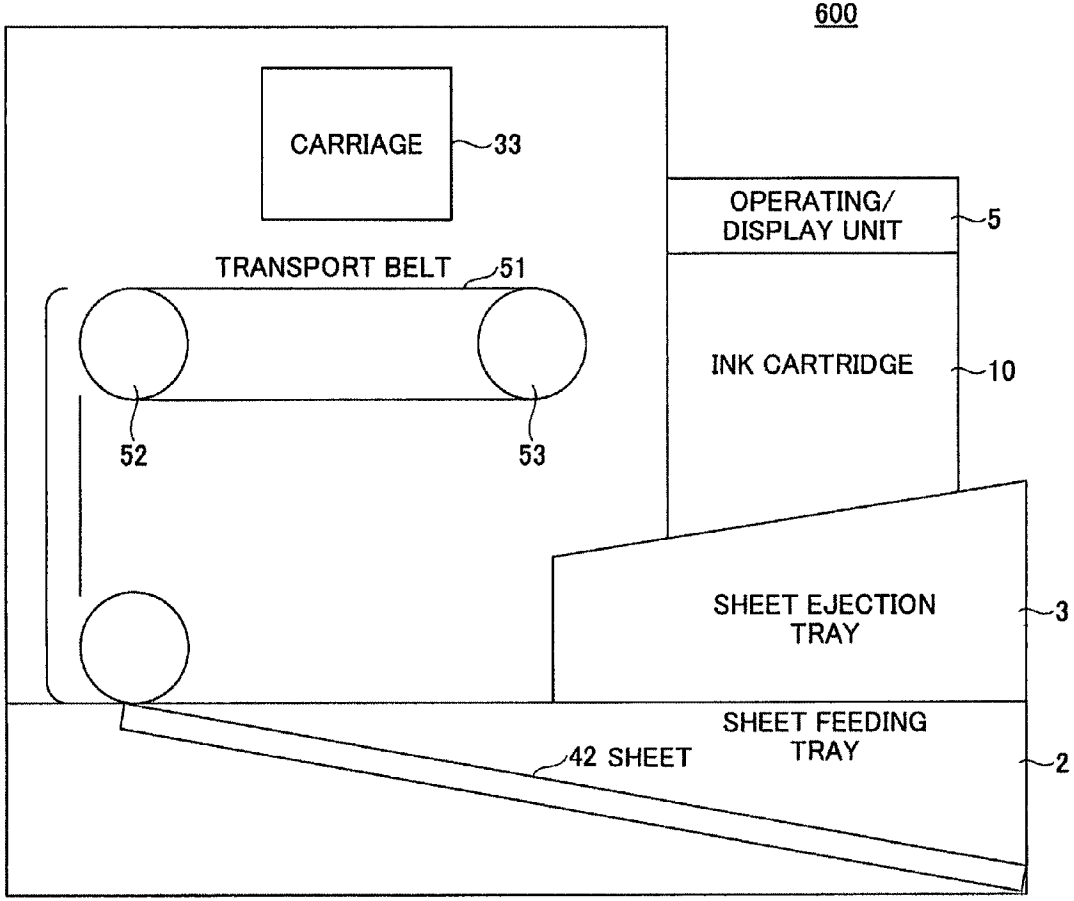
FIG. 1 is a side view of a recording apparatus according to an embodiment of the present invention.
Figure 2:
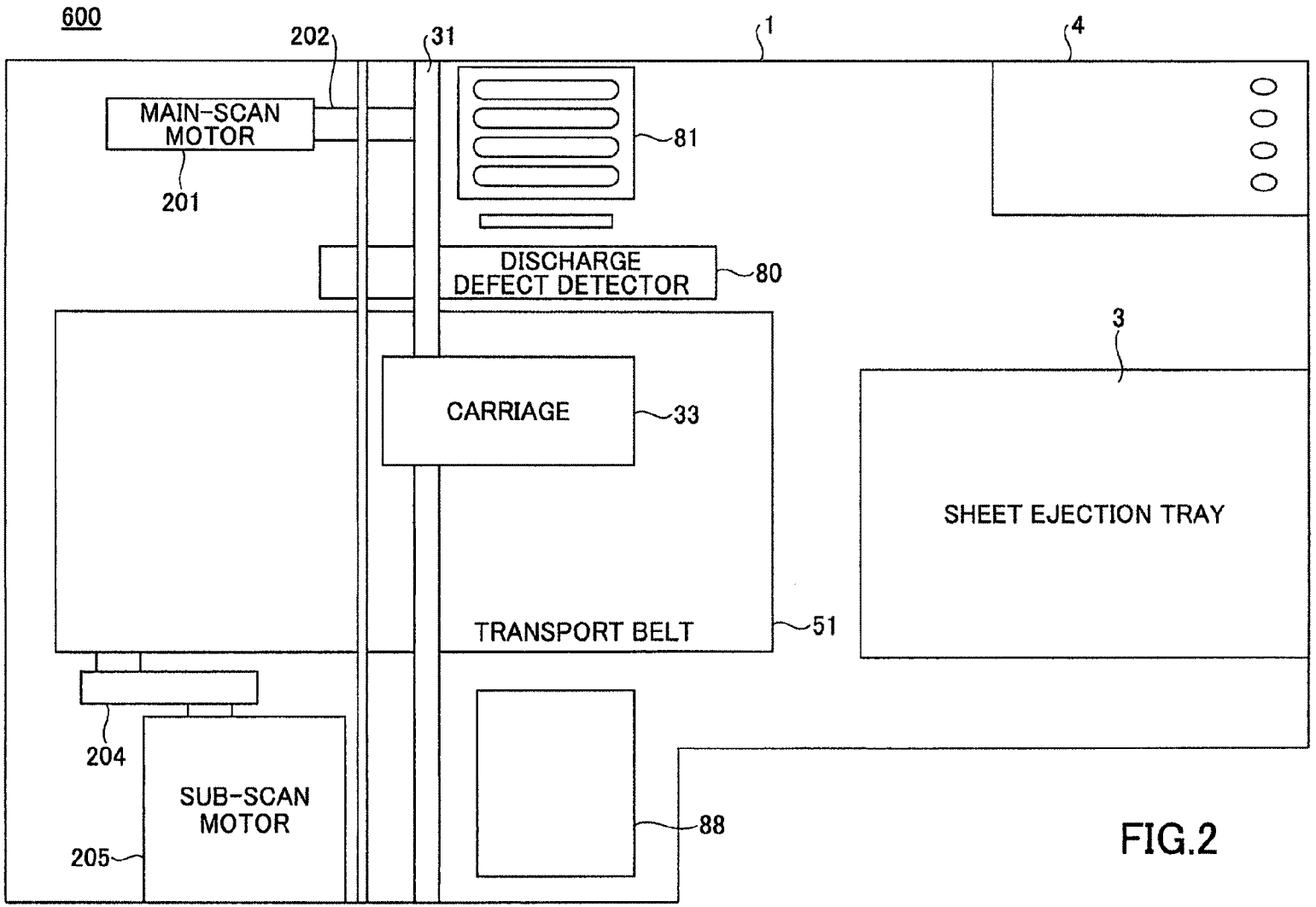
FIG. 2 is a top plan view of the recording apparatus.

FIG. 1 is a schematic side view of a recording apparatus 600 illustrating its internal structure. The recording apparatus 600 includes a carriage 33 disposed above a transport belt 51 extended across a transport roller 52 and a tensioning roller 53. FIG. 2 is a schematic top plan view of the recording apparatus 600, illustrating its internal structure. The carriage 33 is slidably supported by a guide rod 31 which is a guide member laterally mounted between side plates 21A and 21B of a frame 21 (see FIG. 3). Thus, the carriage 33 is slidable in main scan directions M1 (forward direction) and M2 (backward direction). The carriage 33 is configured to be moved in the main scan directions M1 and M2 by a main scan motor 201 (FIG. 2) via a timing belt 202.

Figure 3:
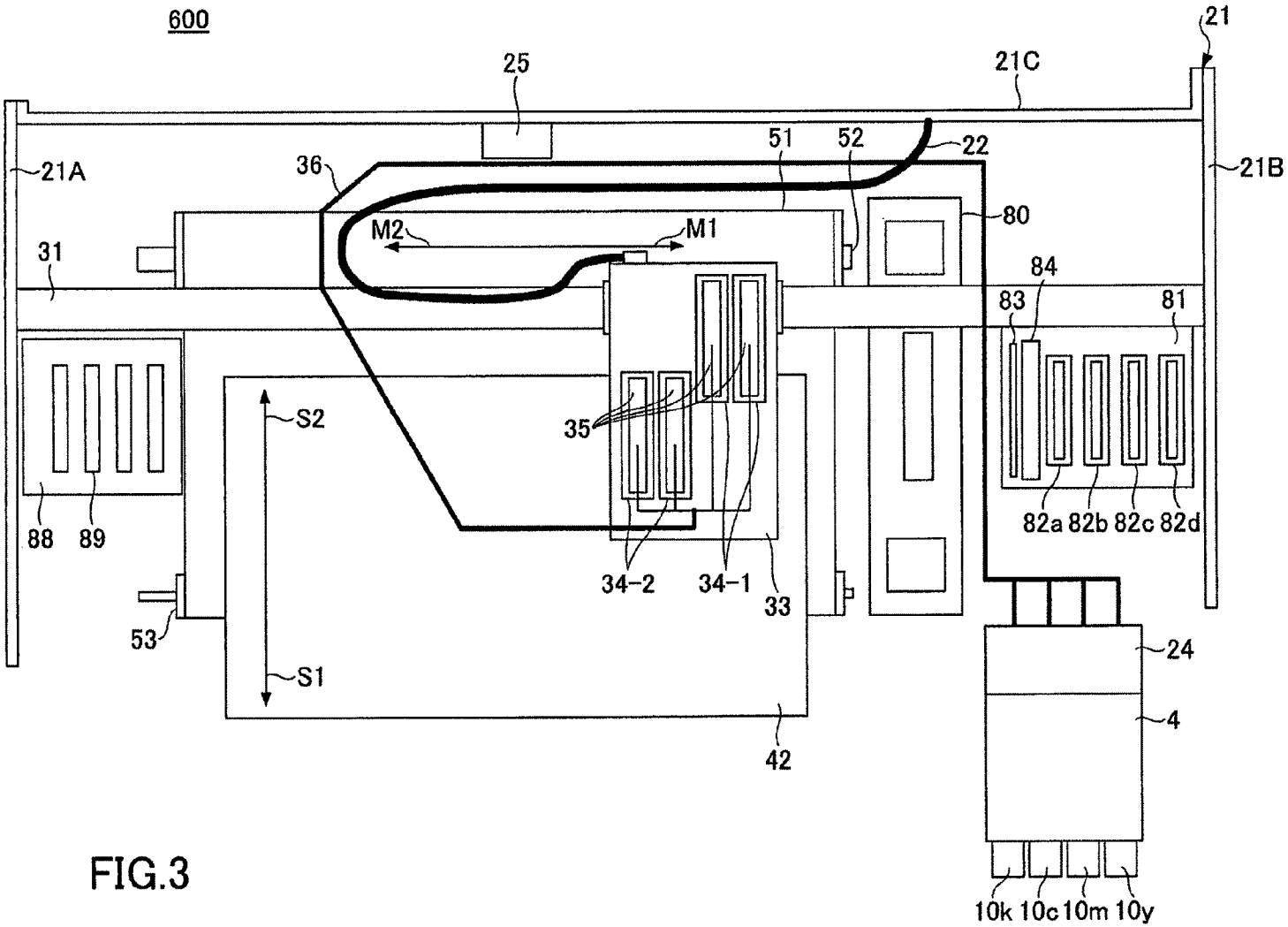
FIG. 3 is a top plan view of a main portion of the recording apparatus.

FIG. 3 is a schematic plan view of a main portion of the recording apparatus 600. The carriage 33 carries a first head group 34-1 of recording heads and a second head group 34-2 of recording heads. The recording heads in the first and the second head groups 34-1 and 34-2 are configured to discharge ink droplets of yellow (Y), cyan (C), magenta (M), and black (K). Ink discharge openings of the first and the second head groups 34-1 and 34-2 for the respective colors of ink droplets may be arranged along lines perpendicular to the main scan directions M1 and M2 and facing downward, so that the ink droplets can be discharged onto a recording medium 42, such as a sheet of paper, placed under the carriage 33.

The first and the second head groups 34-1 and 34-2 may include various pressure generating mechanisms for generating the pressure to discharge ink droplets. Examples of the pressure generating mechanisms include a piezoelectric actuator; a thermal actuator based on a phase change due to film boiling of a liquid caused by an electric-thermal converting element, such as a heat-generating resistor; a shape-memory alloy actuator using the metal-phase change caused by a temperature change; and an electrostatic actuator using electrostatic force. The first and the second head groups 34-1 and 34-2 may include a driver IC (integrated circuit) and be connected to a control unit (not shown) via a flexible print cable 22.

The carriage 33 also carries sub-tanks 35 for supplying the various colors of ink to the recording heads in the first and the second head groups 34-1 and 34-2. The sub-tanks 35 are supplied with the various colors of ink from ink cartridges 10*k*, 10*c*, 10*m*, and 10*y* via an ink supply tube 36. The ink cartridges 10*k*, 10*c*, 10*m*, and 10*y* are attached to a cartridge mount unit 4. The cartridge mount unit 4 includes a supply pump unit 24 for supplying the ink from the ink cartridges, 10*c*, 10*m*, and 10*y*. The ink supply tube 36 may be retained on a back place 21C using a locking member 25. The transport belt 51 is an endless belt extended between the transport roller 52 and the tensioning roller 53. The transport belt 51 may be configured to be rotated in a belt transport direction (sub-scan direction) S1 or S2 when the transport roller 52 is driven by the sub-scan motor 205 (FIG. 2) via a drive belt 204.

As illustrated in FIGS. 2 and 3, in a non-printing area on one end along the guide rod 31, there are provided a discharge defect detecting unit 80 and a maintenance/restore mechanism 81 for maintaining or restoring a desired condition of the nozzles of the recording heads 34-1 and 34-2. The maintenance/restore mechanism 81 includes caps 82*a* through 82*d* for capping nozzle surfaces of the first and the second head groups 34-1 and 34-2, a wiper blade 83 for wiping the nozzle surfaces, and a blank discharge receiver 84 for receiving droplets that do not contribute to recording ("non-recording-contributing ink droplets") during a blank discharge operation. The blank discharge operation may involve causing the first and the second head groups 34-1 and 34-2 to discharge non-recording-contributing ink droplets in order to eject a recording fluid with increased viscosity. The cap 82*a* may be used for suction and moisture-maintaining purposes, while the other caps 82*b* through 82*d* may be used for moisture-maintaining purpose.

In another non-printing area on the other end along the rod 31 (to the left in FIG. 3), there is provided a blank discharge receiver 88 for receiving non-recording-contributing ink droplets during a blank discharge operation for ejecting recording fluid with increased viscosity during a recording operation, for example. The blank discharge receiver 88 may have openings 89 parallel to the lines of the nozzles of the recording heads in the first and the second head groups 34-1 and 34-2.

Printing Mechanism

Figure 4:
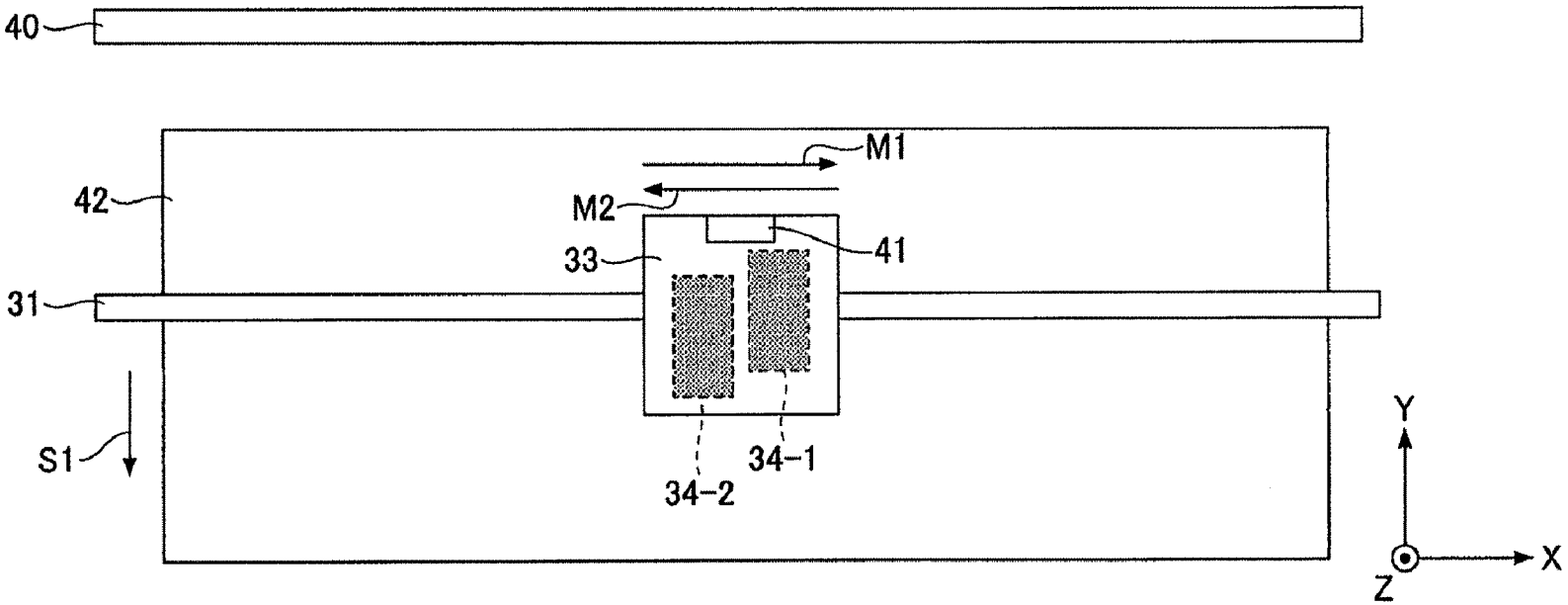
FIG. 4 is a plan view of a printing mechanism of the recording apparatus.
Figure 5:
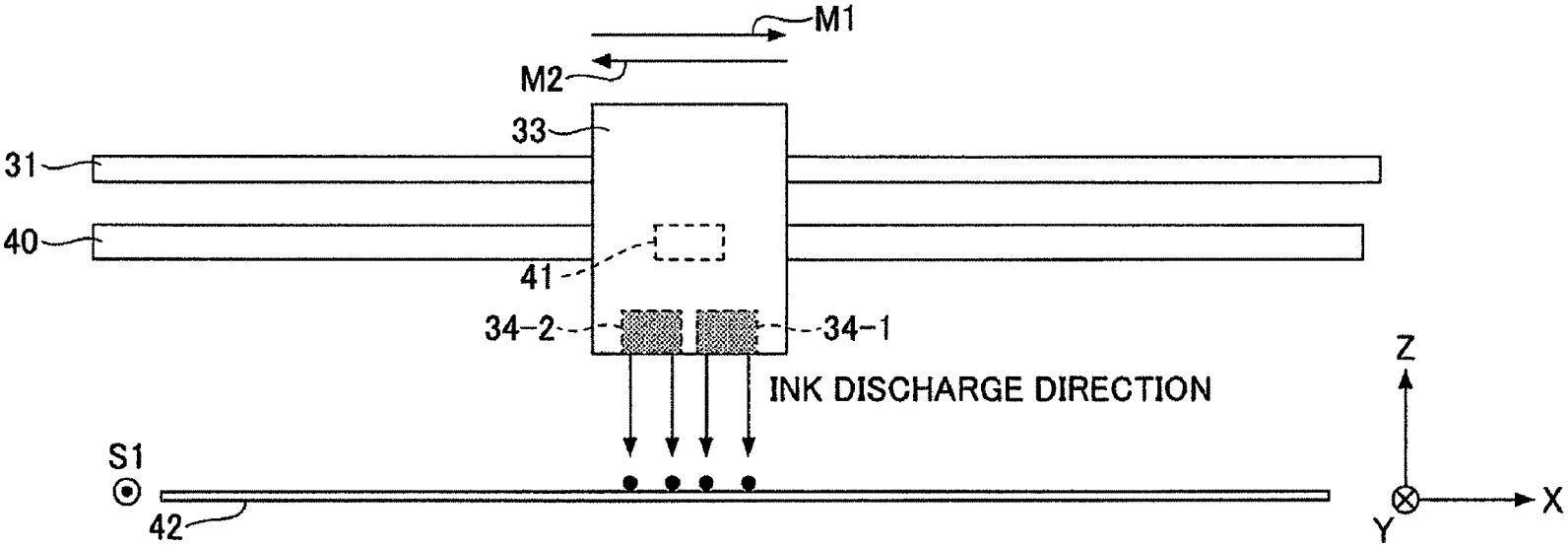
FIG. 5 is a side view of the printing mechanism of the recording apparatus.

FIGS. 4 and 5 are a top plan view and an elevational view, respectively, of a printing mechanism of the recording apparatus 600. Referring to FIGS. 4 and 5, the printing mechanism includes the carriage 33, the guide rod 31, and an encoder scale 40. The carriage 33 includes an encoder sensor 41 as well as it carrying the first and the second head groups 34-1 and 34-2. The recording heads in the first and the second head groups 34-1 and 34-2 may include plural lines of nozzles via which droplets of ink can be discharged onto the sheet 42 so as to form an image (of dots) on the sheet 42. The carriage 33 is movable in the main scan directions M1 and M2, as mentioned above. In accordance with an embodiment of the present invention, the carriage 33 is moved in the main scan directions M1 and M2 while the first and the second head groups 34-1 and 34-2 are driven in accordance with a predetermined print timing signal so that ink droplets are discharged out of the nozzles onto the sheet 42 at a predetermined timing, thus forming a line of an image on the sheet 42. The sheet 42 is then transported in the sub-scan direction S1 by the transport roller 52 and the like, and then the operation of forming another line of the image is repeated. In this way, the desired image can be formed on the sheet 42.

Figure 8:
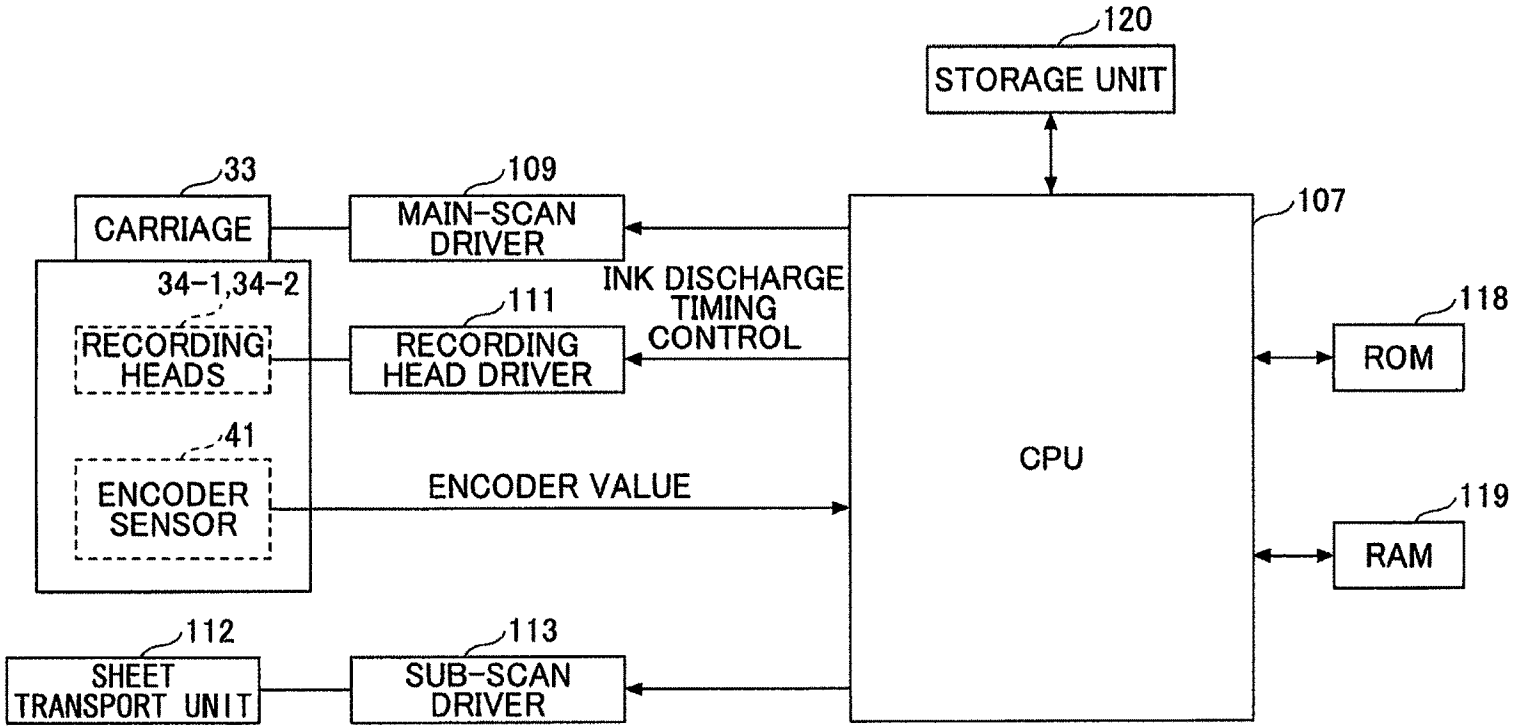
FIG. 8 illustrates an example of a control mechanism of the recording apparatus.

The encode sensor 41 detects a mark (not illustrated) provided on the encoder scale 40, and then feeds an encoder value corresponding to the mark back to a CPU 107 (FIG. 8).

The CPU 107 monitors the position of the carriage 33 in the main scan directions M1 and M2 based on the encoder values obtained from the encoder sensor 41, and controls the movement of the carriage 33 in the main scan directions M1 and M2.

Figure 6:
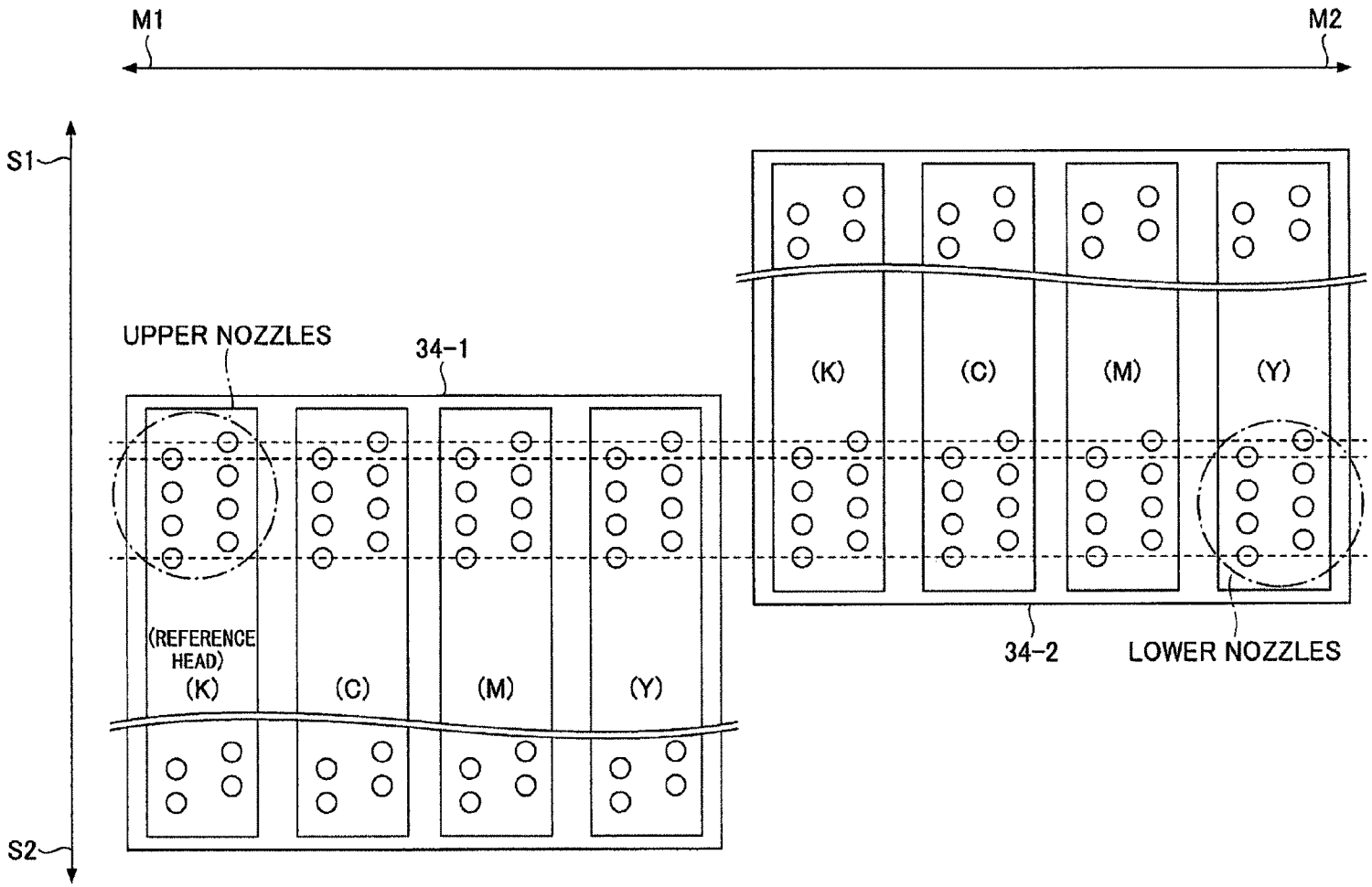
FIG. 6 illustrates a first head group and a second head group mounted on a carriage of the recording apparatus.

FIG. 6 illustrates the first head group 34-1 and the second head group 34-2 carried on the carriage 33 in a staggered manner. The first head group 34-1 includes recording heads 1 through 4, and the second head group 34-2 includes recording heads 5 through 8. In accordance with the present embodiment, each of the recording heads 1 through 8 includes 400 nozzles arranged in two columns. The recording heads 1 through 8 may be configured to discharge ink droplets of the four colors of cyan (C), magenta (M), yellow (Y), and black (K), as illustrated.

As illustrated in FIG. 6, the first head group 34-1 and the second head group 34-2 are staggered along the sub-scan directions S1 and S2 such that the position of a group of upper nozzles of the first head group 34-1 are aligned with the position of a group of lower nozzles of the second head group 34-2 along the sub-scan directions S1 and S2, as indicated by the broken lines in FIG. 6.

Figure 7:
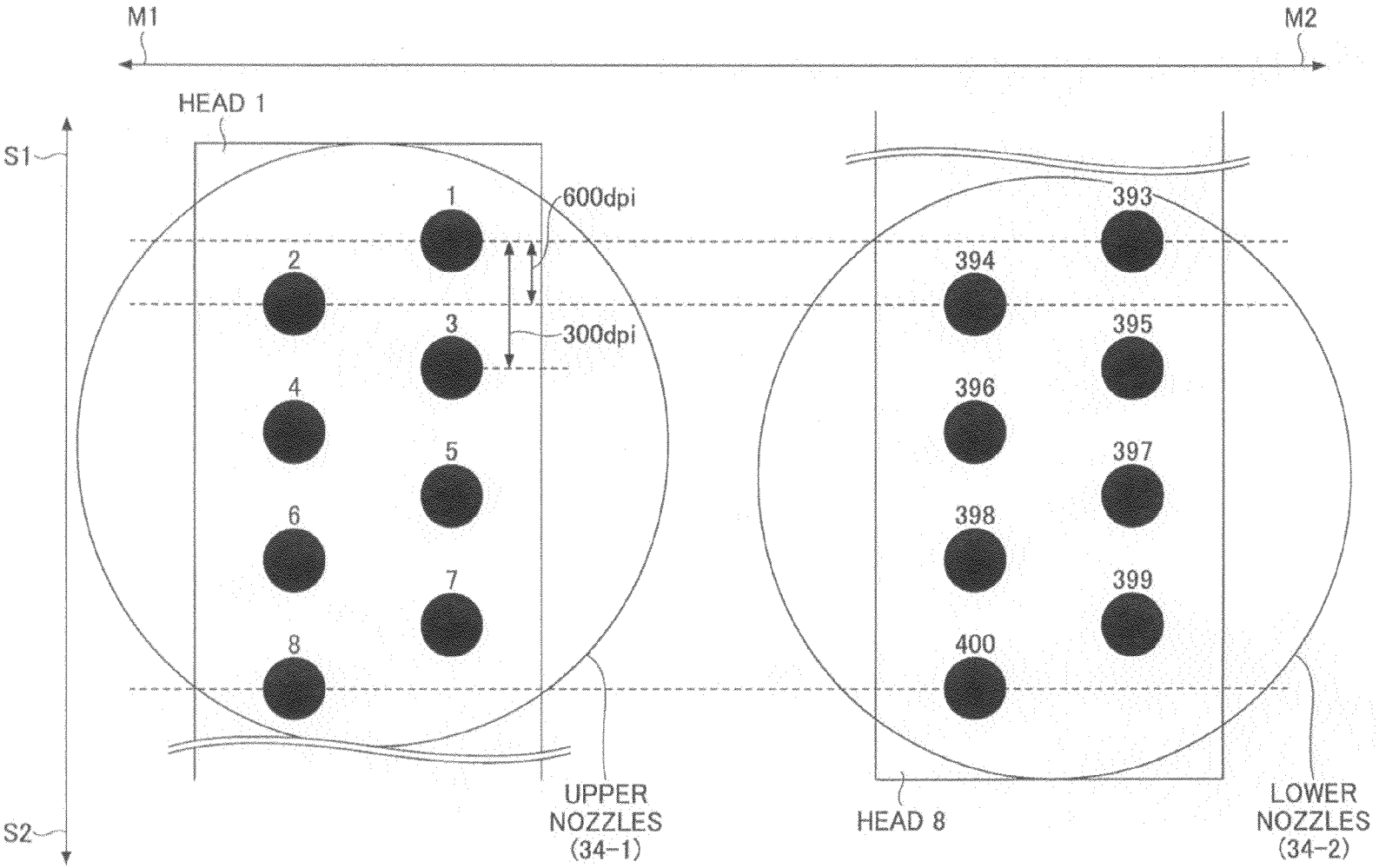
FIG. 7 is an enlarged view of a portion of the first head group and the second head group.

FIG. 7 is an enlarged view of the upper nozzles of the recording head 1 of the first head group 34-1 and the lower nozzles of the recording head 8 of the second head group 34-2 illustrated in FIG. 6. The upper nozzles of the first head group 34-1 are designated with numerals 1 through 8, while the lower nozzles of the second head group 34-2 are designated with numerals 393 through 400, from top to bottom, the top corresponding to the sub-scan direction S1. In accordance with the present embodiment, the upper eight nozzles (1-8) of the first head group 34-1 are aligned with the lower eight nozzles (393-400) of the second head group 34-2 with respect to the sub-scan directions S1 and S2. Such an alignment of the nozzles is in accordance with the normal position.

In FIG. 7, the nozzles 1 and 3 have a dot spacing of 300 dpi in the sub-scan directions S1 and S2. The nozzle 2 is disposed at an intermediate position between the nozzles 1 and 3. Thus, the dot spacing between the nozzles 1 and 2 in the sub-scan directions S1 and S2 is 600 dpi. The first head group 34-1 may be hereafter referred to as "the first recording head 34-1" and the second head group 34-2 may be referred to as "the second recording head 34-2".

When the first and the second head groups 34-1 and 34-2 are mounted at the normal position on the carriage 33 as illustrated in FIGS. 6 and 7, no printing position error occurs and a printing operation can be performed properly. However, in practice, the first head group 34-1 or the second head group 34-2 may be shifted from the normal position due to various reasons, such as the location of the first and the second head groups 34-1 and 34-2 (including mechanical accuracy), the environment in which the recording heads are used, and the period of use. When a printing position error occurs, an image break or density irregularities may appear in a printed image. Thus, it is necessary to provide a mechanism for correcting a printing position error in the sub-scan direction caused by the recording heads 34-1 and 34-2 being disposed in a staggered manner.

In the recording apparatus 600 according to the present embodiment, test patterns p1 and p2 are formed on the sheet 42 using the upper nozzles of the first head group 34-1 and the lower nozzles of the second head group 34-2. The formation of the test patterns p1 and p2 is repeated in the sub-scan direction, thus creating a correction chart. Based on the correction chart, a printing position error of the first and the second head groups 34-1 and 34-2 in the sub-scan directions S1 and S2 is detected and corrected as described below.

Control Mechanism of Recording Apparatus

FIG. 8 is a block diagram of a control mechanism of the recording apparatus 600. The control mechanism includes a CPU (central processing unit) 107, a ROM (read-only memory) 118, a RAM (random access memory) 119, a storage unit 120, the carriage 33, a main scan driver 109, the first and the second head groups 34-1 and 34-2, a recording head driver 111, the encoder sensor 41, a sheet transport unit 112, and a sub-scan driver 113.

The CPU 107 may be configured to send recording data or a drive control signal (pulse signal) to the storage unit 120 and the various drivers in order to control the recording apparatus 600 as a whole. For example, the CPU 107 controls the main scan motor 201 illustrated in FIG. 3 via the main scan driver 109, and also controls the driving of the carriage 33 in the main scan direction. The CPU 107 may also control, via the recording head driver 111, the timing of ink discharge by the first and the second head groups 34-1 and 34-2. Further, the CPU 107 controls, via the sub-scan driver 113, the sub-scan motor 205 illustrated in FIG. 2 in order to control the driving of the sheet transport unit 112 (including the drive belt 204 and the transport belt 51) in the sub-scan directions S1 and S2.

The encoder sensor 41 outputs an encoder value obtained by detecting a mark on the encoder scale 40 (FIG. 5) to the CPU 107. Based on the encoder value, the CPU 107 controls the main scan motor 201 via the main scan driver 109, thus controlling the movement of the carriage 33 in the main scan direction. The ROM 118 stores various information, such as a program encoding a process sequence executed by the CPU 107. The RAM 119 may be used as a working memory.

Method of Detecting Printing Position Error

Figure 9:
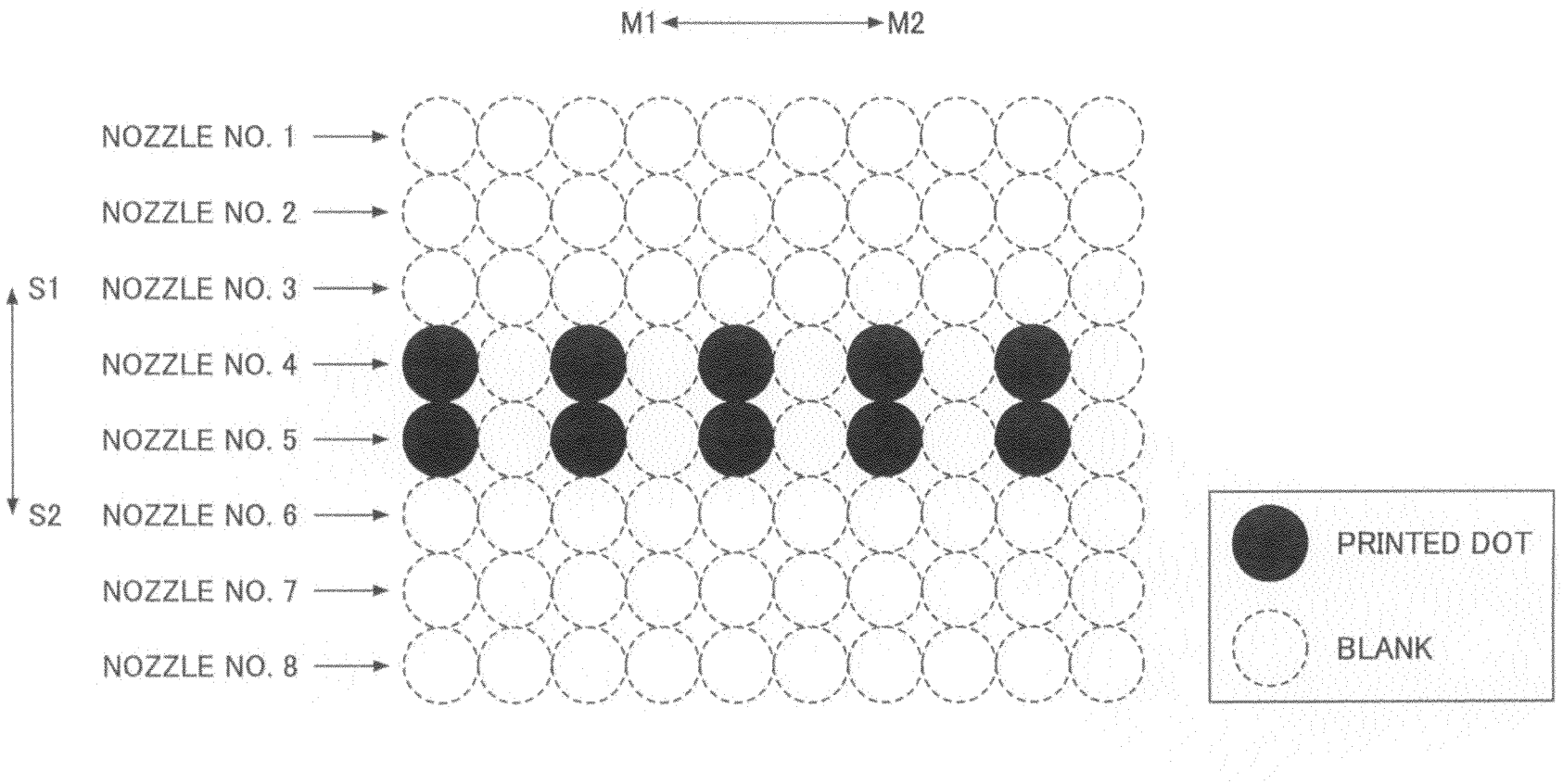
FIG. 9 illustrates a printed pattern (first pattern) formed by a reference head of the first head group.
Figure 10:
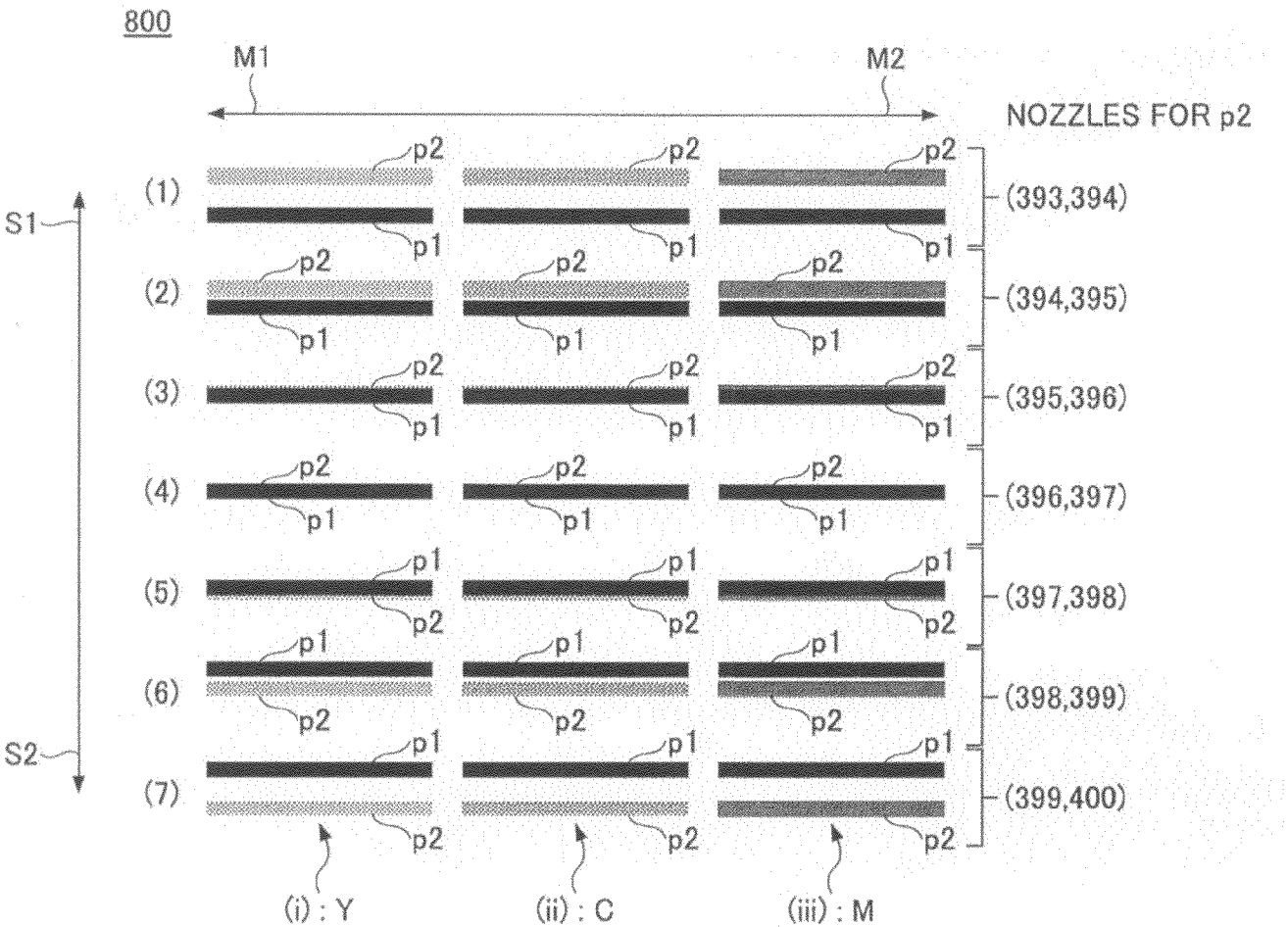
FIG. 10 illustrates a correction chart where there is no printing position error.

With reference to FIGS. 9 through 11, a method of detecting a printing position error is described. FIG. 9 illustrates how a first pattern p1 may be printed using the first (reference) head group 34-1 (FIG. 6). FIG. 10 illustrates a correction chart 800. FIGS. 11A through 11G illustrate various arrangements of the test patterns p1 and p2 in the correction chart 800.

Referring to FIG. 10, the correction chart 800 includes pairs (1) through (7) of the test patterns p1 and p2 which may be formed in two or more colors. The pairs (1) through (7) of the patterns p1 and p2 are arranged in columns (i), (ii), and (iii). For example, in column (i), the test patterns (reference patterns) p1 are printed by the (K) recording head 1 of the first head group 34-1, and the test patterns (correction patterns) p2 are printed by the (Y) correction head 8 of the second head group 34-2. The first patterns p1 are reference patterns and formed in black (K). The second patterns p2 are correction patterns and formed in the colors yellow (Y) in column (i), cyan (C) in column (ii), and magenta (M) in column (iii).

In the correction chart 800 illustrated in FIG. 10, the first patterns (reference patterns) p1 are printed by the nozzles 4 and 5 of the recording head 1 (K) of the first head group 34-1 (see also FIGS. 6, 7, and 9). The second patterns (correction patterns p2) are printed by the nozzles 393 through 400 of the recording heads 6 through 8 (C, M, and Y) of the second head group 34-2, including the nozzles 396 and 397 whose sub-scan positions should be aligned with the nozzles 4 and 5 of the recording head 1 (K) in the normal position. The nozzles used for forming the second patterns p2 vary depending on the rows (1) through (7).

FIG. 9 illustrates how the reference pattern p1 may be printed. In the illustrated example, the reference pattern p1 is formed in two successive lines in the sub-scan direction S2 (opposite to the sheet transport direction S1) using the nozzles 4 and 5 of the recording head 1 of the first head group 34-1. In the main scan directions M1 and M2 along which the recording heads 34-1 and 34-2 are moved, dots are printed alternately. Namely, dots and blanks are alternately provided in the main scan directions M1 and M2. The second patterns p2 may also be printed in the same way as the reference patterns p1. The dots may be printed alternately in the main scan directions M1 and M2 in order to prevent the decrease in visibility of the test patterns p1 and p2 due to the running of ink dots.

The test patterns (reference patterns p1 and the correction patterns p2) have the same pattern structure in the correction chart 800 illustrated in FIG. 10. Namely, the reference patterns p1 in columns (i), (ii), and (iii) are printed in the sub-scan direction S2 (which is downward in the sheet of FIG. 10) at equal intervals. The correction patterns p2 are successively shifted one dot at a time at positions along the sub-scan direction S2. By printing the reference patterns p1 at equal intervals in the sub-scan direction S2, speed variations or printing irregularities in the directions M1 and M2 of movement of the recording heads 34-1 and 34-2 can be minimized, so that the accuracy of the test patterns p1 and p2 can be improved and the visibility of the test patterns p1 and p2 can be increased.

Figure 11A:
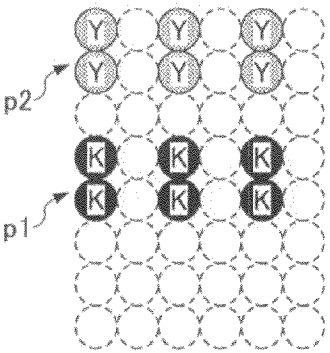
FIG. 11A illustrates an example of test patterns in the correction chart where there is a a-line error in one sub-scan direction.
Figure 11B:
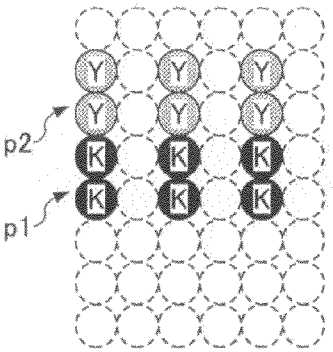
FIG. 11B illustrates an example of test patterns in the correction chart where there is a 2-line error in one sub-scan direction.
Figure 11C:
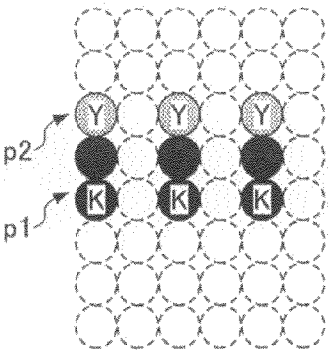
FIG. 11C illustrates an example of test patterns in the correction chart where there is a I-line error in one sub-scan direction.
Figure 11D:
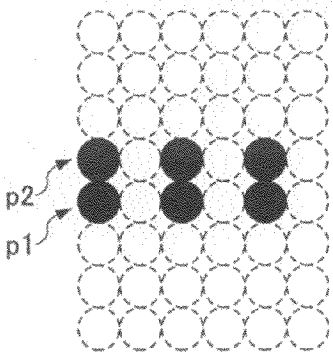
FIG. 11D illustrates an example of test patterns in the correction chart where there is no position error.
Figure 11E:
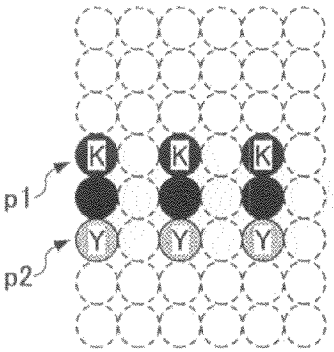
FIG. 11E illustrates an example of test patterns in the correction chart where there is a 1-line error in the other sub-scan direction.
Figure 11F:
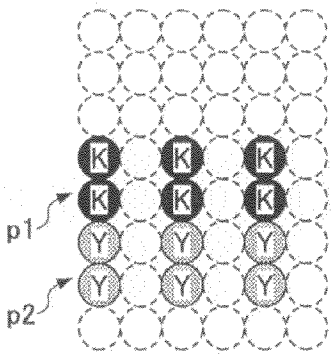
FIG. 11F illustrates an example of test patterns in the correction chart where there is a 2-line error in the other sub-scan direction.
Figure 11G:
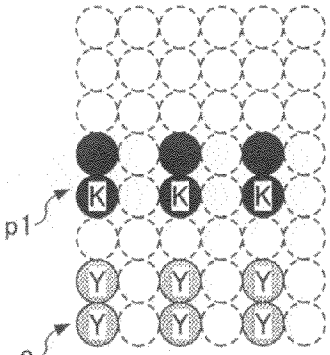
FIG. 11G illustrates an example of test patterns in the correction chart where there is a 3-line error in the other sub-scan direction.

FIGS. 11A through 11G illustrate examples of the reference pattern (black; K) p1 and the correction pattern (yellow; Y) p2. When the first and the second head groups 34-1 and 34-2 are positioned at the normal position, there is no printing position error between the first and the second head groups 34-1 and 34-2, so that the correction patterns p2 (such as those printed with the nozzles 396 and 397 of the recording head 8 of the second head group 34-2) are completely aligned with the reference patterns (such as those printed with the nozzles 4 and 5 of the recording head 1 of the first head group 34-1), as illustrated in FIG. 11D (no position error). In this case, the color yellow (Y) of the correction pattern p2, for example, is absorbed by the color black (K) of the reference pattern p1, so that the test patterns p1 and p2 as a whole practically appear to be black (K) to a user.

However, when the first or the second head group 34-1 or 34-2 is shifted from the normal position, a printing position error occurs. As a result, the correction patterns p2 (which may be printed with the nozzles 396 and 397 of the recording head 8 of the second head group 34-2) are not completely aligned with the reference patterns p1 (which may be printed with the nozzles 4 and 5 of the recording head 1 of the first head group 34-1). Thus, the color (such as yellow) of the correction patterns p2 becomes visible, as illustrated in FIGS. 11A through 11C and 11E through 11G.

Thus, the test patterns p1 and p2 having the closest alignment in print position between the first and the second head groups 34-1 and 34-2 disposed in a staggered manner in the sub-scan direction can be selected by observing the color of the test patterns p1 and p2 in the correction chart 800.

Figure 12:
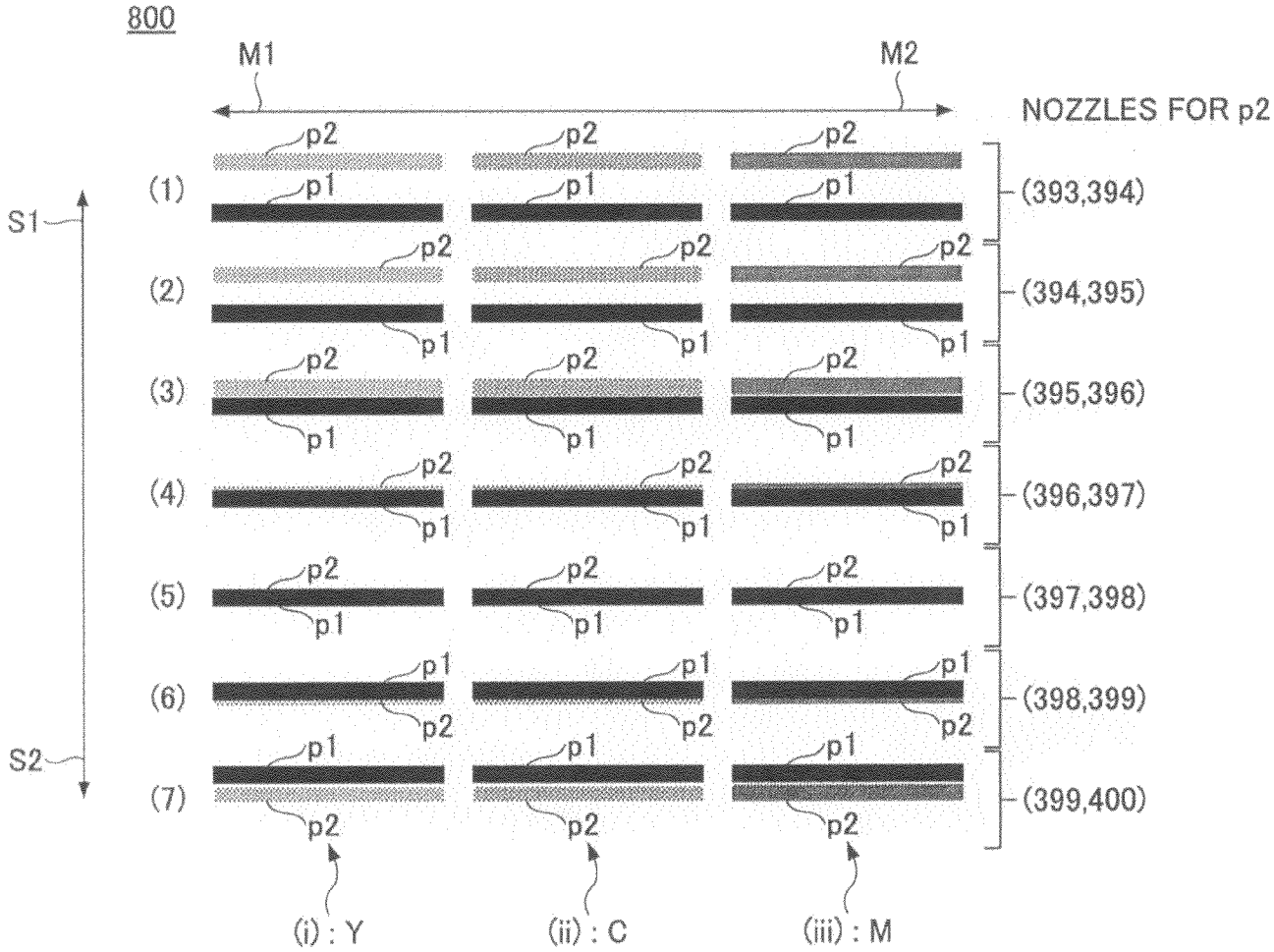
FIG. 12 illustrates a correction chart where there is a printing position error.

FIG. 12 illustrates another example of the test patterns p1 and p2 in the correction chart 800 formed by using the recording apparatus 600. In this case, in the pair (4) of the patterns p1 and p2 arranged in the columns (i) through (iii), the correction patterns p2 printed with the nozzles 396 and 397 of the second head group 34-2 are shifted from the reference patterns p1 by a distance corresponding to one dot in the sub-scan direction S1, in contrast to the example of FIG. 10. As a result, the color other than the color of the reference pattern p1 (i.e., yellow, cyan, or magenta) becomes visible as illustrated in FIG. 11C (one-line shift). In the case of the pair (5), the correction patterns p2 printed with the nozzles 397 and 398 of the second head group 34-2 are completely aligned with the reference patterns p1. As a result, the row (5) appears as the color of the reference patterns p1; i.e., black (K) as illustrated in FIG. 11D (no position error), because the colors of the correction patterns p2 (yellow, cyan, or magenta) are covered up by the color of the reference patterns p1 (K).

Thus, the user can select the row (5) of the test patterns p1 and p2 as having the closest alignment in print position in the sub-scan direction between the first and the second head groups 34-1 and 34-2 disposed in a staggered manner. Information (correction value) indicating the selected row (5) of the test patterns p1 and p2 is then set in the recording apparatus 600. Thus, a subsequent printing operation is controlled in the recording apparatus 600 such that the nozzles 397 and 398 are used as the nozzles of the second head group 34-2 in association with the nozzles 4 and 5 of the first head group 34-1. In this way, the printing position error in the recording apparatus 600 due to the first and the second head groups 34-1 and 34-2 in the sub-scan directions S1 and S2 can be corrected.

While the reference patterns p1 have been described as being formed in black (K) and the correction patterns p2 have been described as being formed in yellow (Y) with reference to FIG. 11, the colors of the patterns p1 and p2 may be varied as needed.

As described above, the user can select the test patterns having the closest alignment in print position between the first and the second head groups 34-1 and 34-2 disposed in a staggered manner in the sub-scan directions S1 and S2 by observing the apparent color created by the overlapping of the reference patterns p1 and the correction patterns p2. Alternatively, it is also possible to select the test patterns having the closest alignment in print position in the sub-scan direction between the first and the second head groups 34-1 and 34-2 disposed in a staggered manner by observing an apparent width of the pairs of the reference pattern p1 and correction pattern p2 that overlap each other in the sub-scan directions S1 and S2. In this case, the pair of the test patterns p1 and p2 having the smallest apparent width in the sub-scan directions S1 and S2 may be considered to have the closest alignment. Thus, in this case, the user may select the pair having the smallest apparent width in the sub-scan directions S1 and S2 as the test patterns p1 and p2 having the closest alignment in print position in the sub-scan direction between the recording heads 34-1 and 34-2 disposed in a staggered manner.

Further, it is also possible to select the pair of the test patterns p1 and p2 having the closest alignment in print position in the sub-scan direction between the recording heads 34-1 and 34-2 disposed in a staggered manner by observing the apparent density of the pairs of the reference pattern p1 and the correction pattern p2. In this case, the pair of the test patterns p1 and p2 having the highest apparent density due to their overlapped portions may be considered to have the closest alignment. Thus, in this case, the user may select the pair of the test patterns p1 and p2 having the highest apparent density as having the closest alignment in print position in the sub-scan direction between the first and the second head groups 34-1 and 34-2 disposed in a staggered manner.

Printing Position Error Correcting Method

Figure 13:
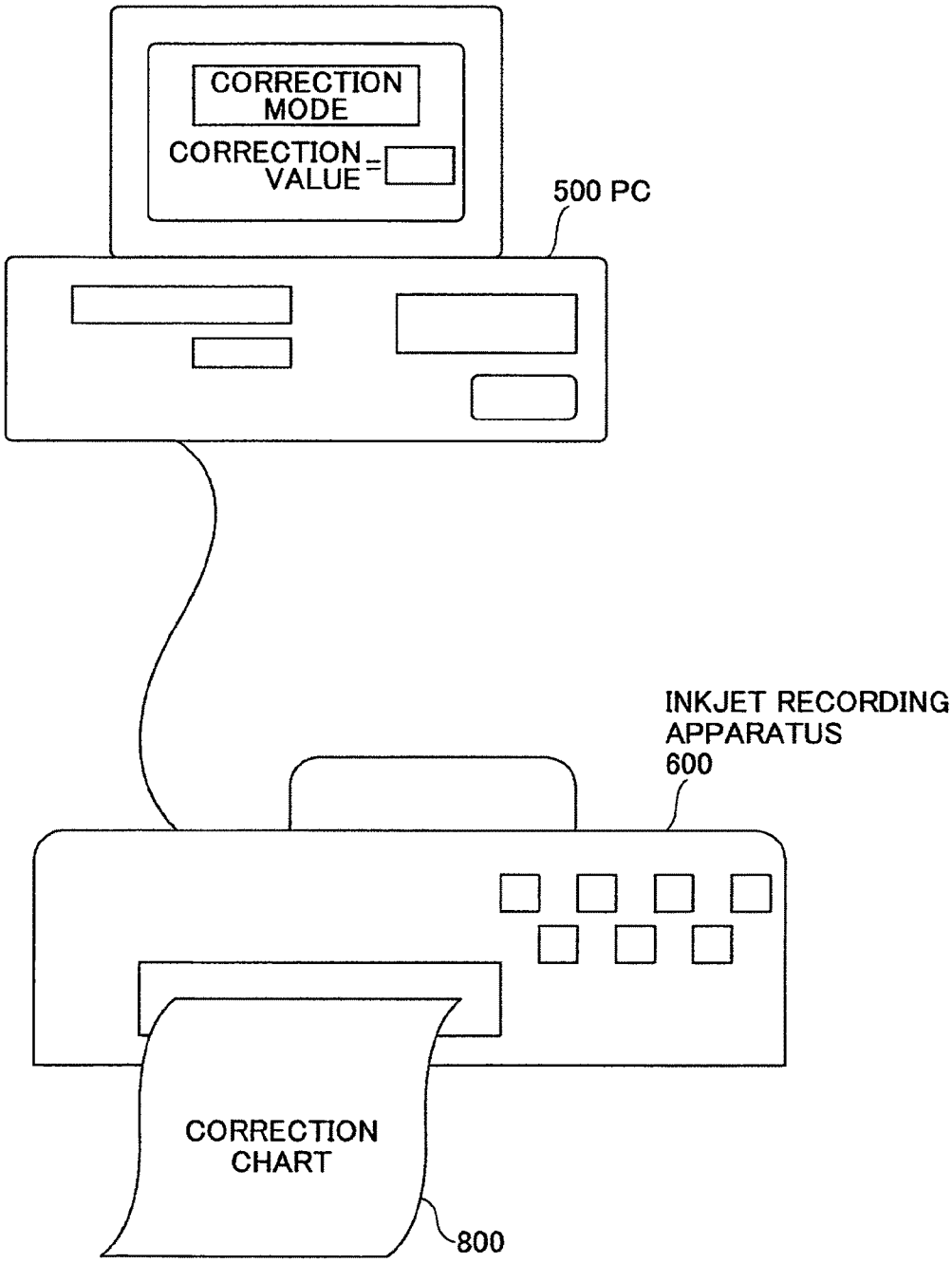
FIG. 13 illustrates a printing position error correcting method.
Figure 14A:
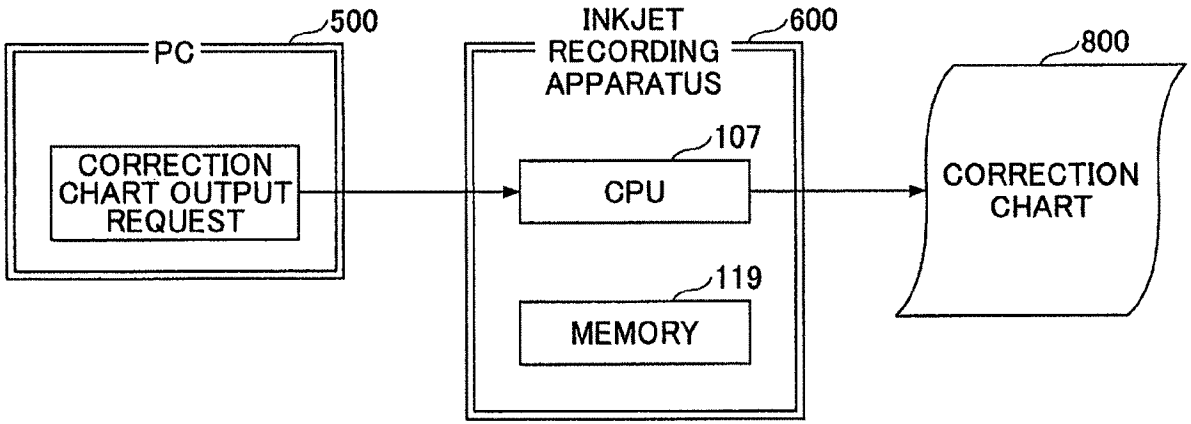
FIG. 14A illustrates a first phase of a printing position error correcting method.
Figure 14B:
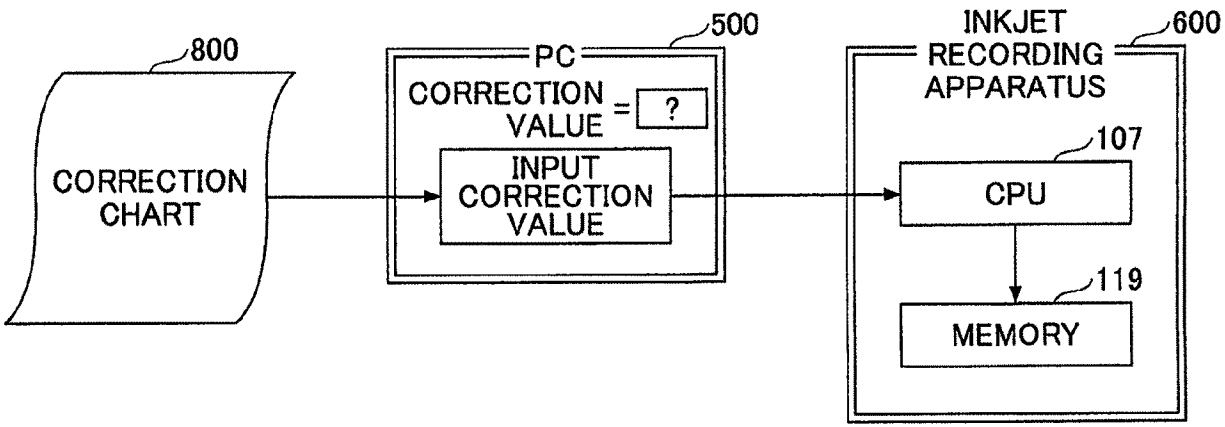
FIG. 14B illustrates a second phase of the printing position error correcting method.

Next, a method of correcting a printing position error is described with reference to FIGS. 13, 14A, and 14B. FIG. 13 illustrates a system for correcting a position error. FIGS. 14A and 14B illustrate a method of correcting a position error.

In the example illustrated in FIG. 13, a PC (personal computer) 500 and a recording apparatus (inkjet recording apparatus) 600 are connected for controlling a printing position error. When a user determines that printing position error control is necessary based on a printed image outputted by the recording apparatus 600, the user enters a request into the PC 500 for the output of the correction chart 800 (FIG. 14A).

Then, based on the test patterns in the correction chart 800 outputted by the recording apparatus 600, the user enters a correction value into the PC 500 (FIG. 14B). The PC 500 may include a display unit configured to display a correction value entry column so that the user can enter the correction value into the correction value entry column. For example, numbers (correction values) are allocated to the test patterns p1 and p2 in the correction chart 800. The user selects the test patterns p1 and p2 having the closest alignment, and then enters the numbers (correction values) allocated to the selected test patterns p1 and p2 into the PC 500.

The correction values entered into the PC 500 may then be stored in a correction value memory (such as the RAM 119 in FIG. 8) of the recording apparatus 600. The recording apparatus 600 then adjusts the nozzle positions of the head groups 34-1 and 34-2 in the sub-scan direction based on the stored correction values, thus correcting the printing position error in the sub-scan directions S1 and S2. Thus, the printing position error in the sub-scan directions S1 and S2 due to the recording heads 34-1 and 34-2 can be corrected even when the first and the second head groups 34-1 and 34-2 are disposed in a staggered manner.

While the foregoing description is directed to a control method performed via the PC 500, the functions described as being realized in the PC 500 may be implemented in the recording apparatus 600, so that the request for printing the correction chart 800 or the entry of the correction values may be performed on an operating unit of the recording apparatus 600. The timing of generating the correction chart 800 may be set as desired. For example, in a preferred embodiment, the correction chart 800 may be automatically generated at the time of replacing the recording heads 34-1 and 34-2 due to degradation.

Figure 15:
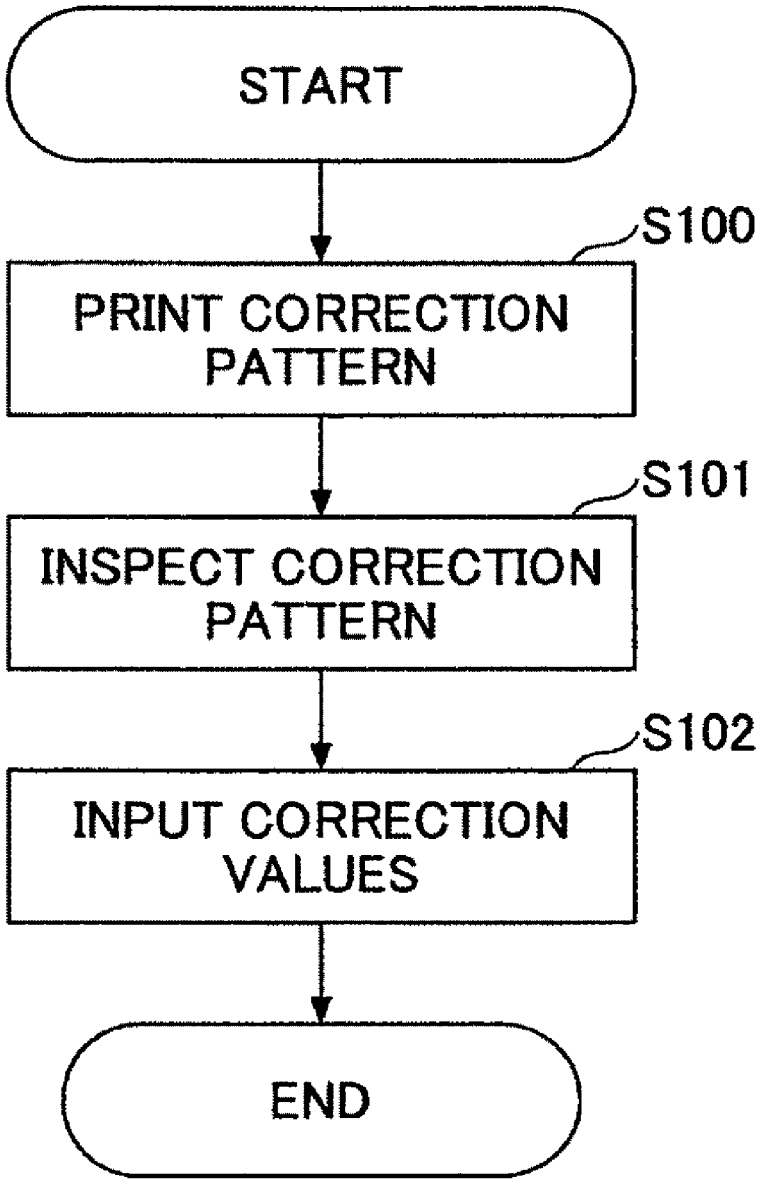
FIG. 15 is a flowchart of the printing position error correcting method.

FIG. 15 is a flowchart of a printing position error correcting method according to the present embodiment. First, a user 700 (see FIG. 18) enters an instruction into the PC 500 for starting the printing position error control process. In response, the recording apparatus 600 prints the test patterns p1 and p2 as described with reference to FIGS. 10 and 12, for example, thus outputting the correction chart 800 in which the test patterns p1 and p2 are printed (step S100).

The user 700 visually inspects the test patterns p1 and p2 in the correction chart 800 (step S101). The user 700 then selects the test patterns p1 and p2 in the correction chart 800 having the closest alignment in print position in the sub-scan direction between the recording heads 34-1 and 34-2 disposed in a staggered manner. The user 700 then enters the correction values (numbers) corresponding to the selected test patterns p1 and p2 via the PC 500 (step S102). In this way, the printing position error due to the recording heads 34-1 and 34-2 disposed in a staggered manner can be corrected.

Figure 16:
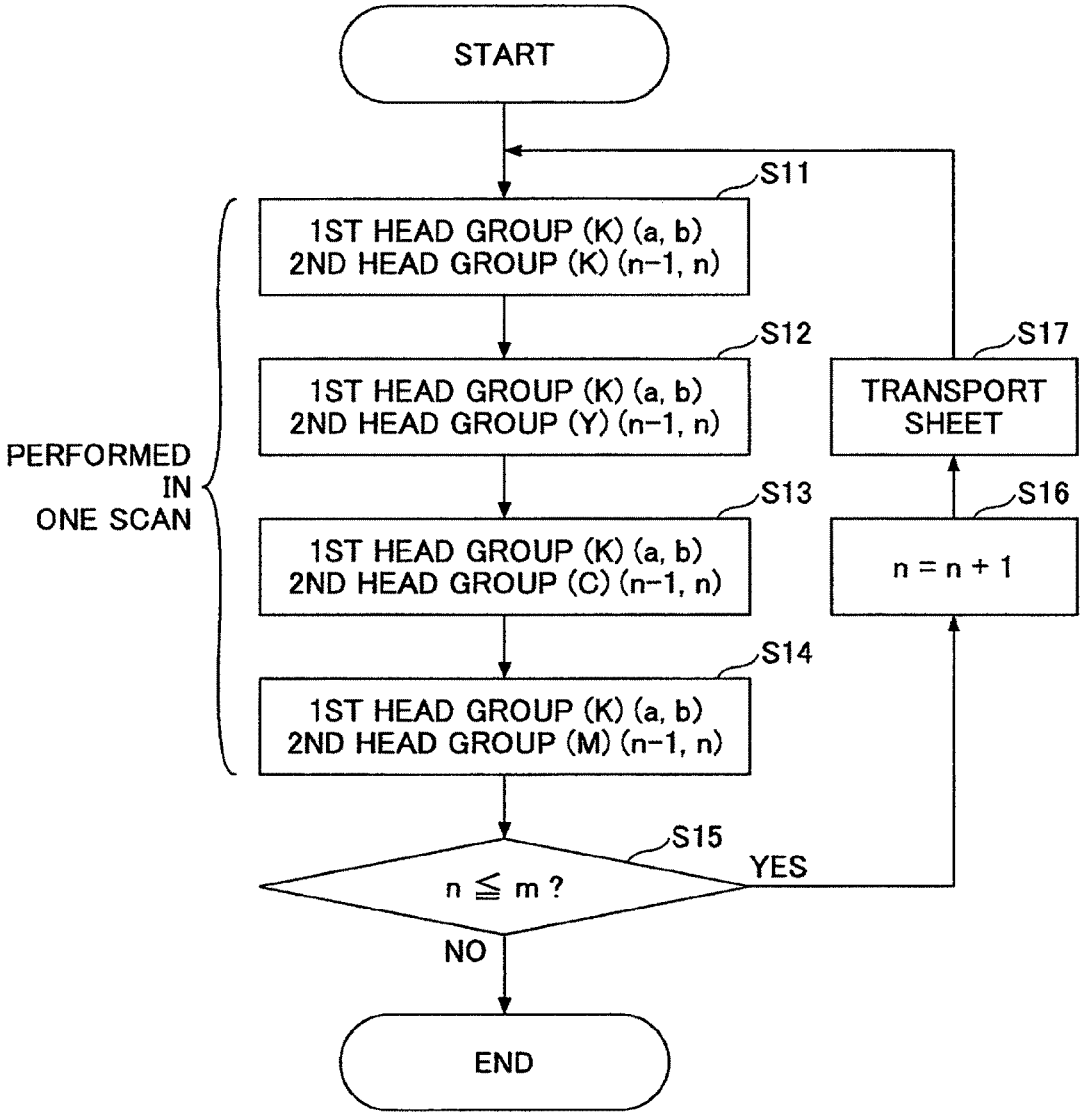
FIG. 16 is a flowchart of a correction pattern printing operation.

FIG. 16 illustrates a flowchart of a correction pattern print process. The reference patterns p1 and the correction patterns p2 may have the same pattern structure. As illustrated in FIGS. 10 and 12, the reference patterns p1 are printed at equal intervals in the directions M1 and M2. Similarly, the correction patterns p2 may be printed at equal intervals in the directions M1 and M2. Then, the sheet on which the test patterns (the reference pattern p1 and the correction pattern p2) have been formed is transported in the sub-scan direction S1 by a predetermined amount and then the reference patterns p1 are again formed at equal intervals in the main-scan directions M1 and M2. Similarly, the correction patterns p2 are formed at equal intervals in the directions M1 and M2. However, at this time, the correction patterns p2 are displaced in the sub-scan direction S2 by a distance corresponding to one nozzle. Thereafter, the process of forming the reference patterns p1 and the correction patterns p2 alternately and transporting the sheet by a predetermined amount in the sub-scan direction S1 is repeated such that the print positions of the correction patterns p2 relative to the positions of the reference patterns p1 are shifted in the sub-scan direction S2 by the distance of one nozzle each time the sheet is transported by the predetermined amount in the sub-scan direction S1.

For example, when forming the test patterns illustrated in FIG. 10, the C, M, and Y heads of the second head group 34-2 are used. In the example of FIG. 6, the C, M, and Y heads of the second head group 34-2 correspond to the heads 6, 7, and 8, while the K (black) head corresponds to the head 5. Similarly, the C, M, and Y heads of the first head group 34-1 correspond to the heads 2, 3, and 4, while the K (black) head corresponds to the head 1. Thus, in the example of FIG. 10, the K head of the second head group 34-2 is not used, so that the printing step (step S11) using the K head of the second head group 34-2 in the flowchart of FIG. 16 may be omitted. The correction patterns p2 printed by the second head group 34-2 may be printed using all of the C, M, Y, and K recording heads (as in the example of FIG. 17), or one of the recording heads may be used.

In FIG. 16, "a" and "b" indicate reference nozzle positions of the first head group 34-1. "n" indicates a nozzle position of the second head group 34-2. "m" indicates a final nozzle of the second head group that is used (which is equal to or less than 400 in the example of FIG. 17).

The reference patterns p1 may be printed using some of the nozzles (a and b) of the K (black) head of the first head group 34-1 (the head may be other than the K head) (a=4 and b=5 in the example of FIG. 9). The reference patterns p1 may be printed by the (K) head of the first head group 34-1 at the same time as the correction patterns p2 are printed by the second head group 34-2, such as by the nozzles 393 and 394 (FIG. 10) of the C, M, and Y heads of the second head group 34-2. In FIG. 10, the correction patterns p2 in column (i) are printed by the Y head; the correction patterns p2 in column (ii) are printed by the C head; and the correction patterns p2 in column (iii) are printed by the M head.

Thereafter, the sheet on which the patterns p1 and the correction patterns p2 have been printed as described above is transported in the sub-scan direction S1 by a predetermined amount. This is to ensure that the three pairs of the test patterns p1 and p2 that are to be printed side by side in the main scan directions M1 and M2 can be clearly distinguished from the previous three pairs of the test patterns p1 and p2. The "predetermined amount" may correspond to a sufficient interval between the first and the second rows of the pairs of the test patterns p1 and p2 in the sub-scan direction S2. The subsequent correction patterns p2 may be printed using the nozzles 394 and 395 (which are displaced from the nozzles 393 and 394 by the amount corresponding to one nozzle) of the C, M, and Y heads of the second head group 34-2.

Thus, the correction patterns p2 are printed by shifting the nozzles of the second head group 34-2 by the distance of one nozzle each time the sheet is transported in the S1 direction, while the nozzles 4 and 5 of the first head group 34-1 are fixed. In this way, the correction chart illustrated in FIG. 10 can be obtained.

Thus, in FIG. 10, initially the three pairs of the test patterns p1 and p2 for the row (1) are printed side by side in the main scan directions M1 and M2, where the Y (column (i)), M (column (ii)), and Y (column (iii)) correction patterns p2 are disposed on the S1 side with respect to the reference patterns p1 (K). After the sheet is transported in the S1 direction by the predetermined amount, the next pairs of the test patterns p1 and p2 for the row (2) are printed side by side in the main scan directions M1 and M2. In the row (2), although the Y, C, and M correction patterns p2 are disposed on the S1 side with respect to the reference patterns p1 (K), the interval between the test patterns p1 and p2 in the sub-scan directions S1 and S2 is narrower than in the case of the row (1). Namely, in the row (2) of the test patterns p1 and p2, the position of the correction patterns p2 relative to the reference patterns p1 is shifted toward the S2 direction compared to the row (1).

After the sheet is further transported in the S1 direction, the next pairs of the test patterns p1 and p2 for the row (3) are printed side by side in the main scan directions M1 and M2. In the row (3), although the Y, C, and M correction patterns p2 are also disposed on the S1 side with respect to the reference patterns p1 (K), there is no interval between the reference patterns p1 and p2 in the sub-scan directions S1 and S2. Thus, in the row (3) of the test patterns p1 and p2, the position of the correction patterns p2 relative to the reference patterns p1 is further shifted in the S2 direction than the row (2) of the test patterns p1 and p2.

After the sheet is further transported in the S1 direction, the next pairs of the test patterns p1 and p2 for the row (4) are printed side by side in the main scan directions M1 and M2. In the row (4), the Y, C, and M correction patterns p2 are completely aligned with the K reference patterns p1. The sheet is further transported in the S1 direction and then the next pairs of the test patterns p1 and p2 for the row (5) are printed side by side in the main scan directions M1 and M2. In the row (5), the correction patterns p2 are further shifted in the S2 direction with respect to the reference patterns p1. As a result, in the row (5), the positional relationship between the reference patterns p1 and the correction patterns p2 in the sub-scan directions S1 and S2 is reversed from the row (3). Namely, in the row (5), the Y, C, and M correction patterns p2 are disposed on the S2 side with respect to the K reference patterns p1. In addition, the patterns p1 and p2 are partially overlapping each other. By thus shifting the position of the correction patterns p2 relative to the reference patterns p1 in the S2 direction in a stepwise manner each time the sheet is transported in the S1 direction, the rows (1) through (7) of the test patterns p1 and p2 illustrated in FIG. 10 can be obtained.

The example of FIG. 10 illustrates a case where there is no printing position error due to the recording heads 34-1 and 34-2 disposed in a staggered manner. Thus, the correction patterns p2 printed using the nozzles 396 and 397 of the second head group 34-2 are completely aligned with the reference patterns p1 (K) of the first head group 34-1 in row (4).

Using the correction chart 800 having the rows (1) through (7) of the test patterns p1 and p2, the user 700 makes a visual determination. Specifically, the user 700 selects the row of the reference patterns p1 and the correction patterns p2 having the smallest apparent overall width in the sub-scan directions S1 and S2. In such a row of the test patterns where the test patterns p1 and p2 appear either very closely or completely overlapped, the print positions are the most closely (or completely) aligned in the sub-scan direction between the recording heads 34-1 and 34-2. In the example of FIG. 10, in the row (4), the reference patterns p1 and the correction patterns p2 are completely overlapping, so that the apparent width of the test patterns p1 and p2 as a whole in the sub-scan directions S1 and S2 is equal to the individual width of the reference pattern p1 or the correction pattern p2 in the sub-scan direction. Thus, the row (4) of the test patterns p1 and p2 has the smallest apparent overall width in the sub-scan directions S1 and S2.

Thus, the row (4) of the test patterns p1 and p2 is selected by the user as having the most closely (or completely) aligned print positions in the sub-scan direction between the recording heads 34-1 and 34-2 disposed in a staggered manner. In this case, in order to help the user understand on what basis the particular row of the test patterns p1 and p2 is selected, the recording apparatus 600 may be configured to cause the display unit of the PC 500 to display a message, such as "Please select the narrowest apparent width", upon printing-out of the correction chart 800 as described with reference to FIG. 14B.

Instead of selecting the patterns p1 and p2 having the narrowest apparent width in the sub-scan directions S1 and S2 as the test patterns p1 and p2 having the most closely or completely aligned print positions in the sub-scan direction, the test patterns p1 and p2 that most clearly appear to be a single color may be selected as the test patterns p1 and p2 having the most closely or completely aligned print positions in the sub-scan direction (such as when the test pattern is formed by combining yellow and magenta). Namely, in the row (4) of the test patterns p1 and p2, the reference patterns p1 and the correction patterns p2 are completely overlapping, so that the color of the reference patterns p1 and the color of the correction patterns p2 cannot be distinguished. Thus, the row (4) of the test patterns p1 and p2 appears the most clearly as a single color. In this case, as in the above-described case, the row (4) of the test patterns p1 and p2 is selected by the user as containing the test patterns p1 and p2 having the most closely or completely aligned print positions in the sub-scan direction between the recording heads 34-1 and 34-1 disposed in a staggered manner. In this case, too, the display unit of the PC 500 described with reference to FIG. 14B may be configured to display a message "Select a pair that appears the most clearly as a single color" when the recording apparatus 600 outputs the correction chart 800 so that the user can be informed of the determination standard for the selection of the test patterns p1 and p2.

The correction chart 800 illustrated in FIG. 10 is an example where there is no such printing position error as mentioned above. In this case, the row (4) of the test patterns p1 and p2 has the print positions that are most closely aligned with each other in the sub-scan direction according to design. On the other hand, when there is a printing position error, as described with reference to FIG. 12, a pair of the test patterns p1 and p2 other than the row (4) (such as the row (5) in the example illustrated in FIG. 12) may be the row of the test patterns p1 and p2 with the most closely aligned print positions in the sub-scan direction. In such a case, too, the user may select the pair of the test patterns p1 and p2 in the same way as described above. Specifically, the user may select the patterns p1 and p2 having the narrowest width in the sub-scan directions S1 and S2, or the row of the test patterns p1 and p2 that appears the most clearly as a single color, as the test patterns p1 and p2 having the most closely aligned print positions in the sub-scan direction.

Thus, in accordance with the present embodiment, the test patterns p1 and p2 having the most closely aligned print positions in the sub-scan directions S1 and S2 between the recording heads 34-1 and 34-2 disposed in a staggered manner are selected, and then information (correction value) indicating the row of the selected test patterns p1 and p2 (such as the row (4) in the aforementioned example) is set in the recording apparatus 600. The information (correction value) indicates which of the nozzles of the recording heads in the first and the second head groups 34-1 and 34-2 disposed in a staggered manner correspond to each other. For example, in the example of FIG. 10, the nozzles 4 and 5 of the first head group 34-1 and the nozzles 396 and 397 of the second head group 34-2 that are used during the printing of the row (4) of the test patterns p1 and p2 having the most closely aligned print positions in the sub-scan directions S1 and S2 are configured to print dots at the same position in the sub-scan directions S1 and S2. Thus, the nozzles 4 and 5 of the first head group 34-1 and the nozzles 396 and 397 of the second head group 34-2 are the corresponding nozzles.

Thus, in the recording apparatus 600, the first and the second head groups 34-1 and 34-2 are disposed in a staggered manner to obtain a virtual recording head unit with an increased length in the sub-scan direction, so that the number of dots that can be printed at the same time can be increased by using some of the nozzles of the recording heads 34-1 and 34-2 simultaneously. In this way, the speed of image formation is increased. Which of the nozzles of the recording heads 34-1 and 34-2 should be used for printing the individual dots is determined based on the information (correction value) set in the recording apparatus 600. As a result, when an image is printed using the first and the second head groups 34-1 and 34-2 disposed in a staggered manner, no position error between the first and the second head groups 34-1 and 34-2 is caused, so that the development of an image break or uneven density distribution due to the position error can be prevented.

In the case of FIG. 10, there are seven rows (1) through (7) of the test patterns p1 and p2, so that the user 700 needs to enter information into the PC 500 indicating that the row (4) has the most closely aligned print positions in the sub-scan direction. In a simplified method, as illustrated in FIG. 10, when the test patterns are printed, the numbers "1" through "7" may be simultaneously printed at the head of the corresponding test patterns. In this way, the user 700 may only need to enter the number of the row of the test patterns having the most closely aligned print positions in the sub-scan direction into the PC 500 (such as "4" in the example of FIG. 10).

Figure 17:
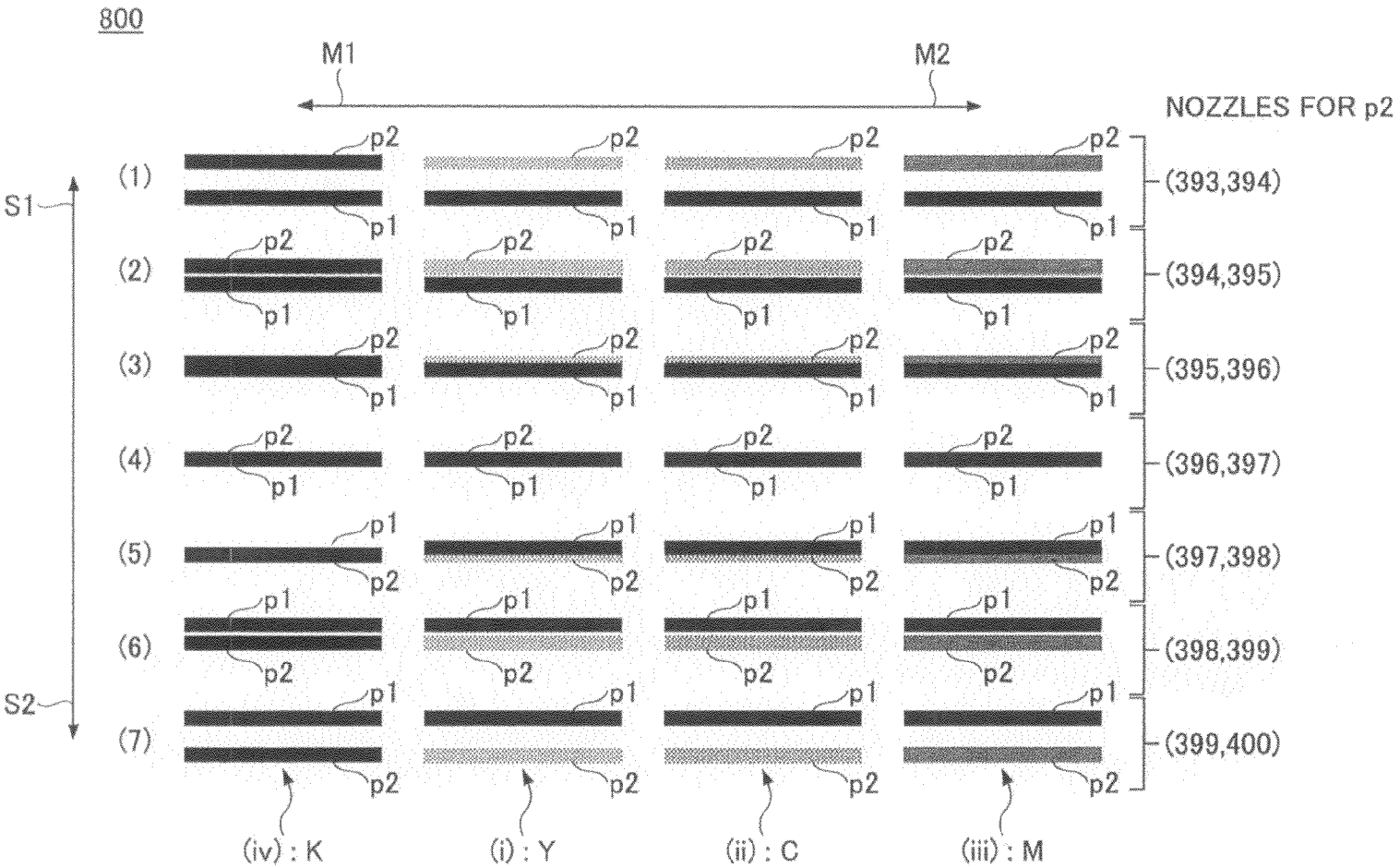
FIG. 17 illustrates another example of the correction chart where there is no printing position error.

Referring to FIGS. 16 and 17, in step S11, the reference pattern p1 and the correction pattern p2 in row (1) and column (iv) are printed by the nozzles a and b (such as the nozzles 4 and 5 in the example of FIG. 17) of the head 1 (K) of the first head group 34-1 (see FIG. 6), and the nozzles n−1 and n (393, 394) of the head 5 (K) of the second head group 34-2.

In step S12, the reference pattern p1 and the correction pattern p2 in row (1) and column (i) are printed by the nozzles a and b (4, 5) of the head 1 (K) of the first head groups 34-1 and the nozzles n-1 and n (393, 394) of the head 8 (Y) of the second head group 34-2.

In step S13, the reference pattern p1 and the correction pattern p2 in row (1) and column (ii) are printed by the nozzles a and b (4, 5) of the head 1 (K) of the first head group 34-1 and the nozzles n-1 and n (393, 394) of the head 6 (C) of the second head group 34-2.

In step S14, the reference pattern p1 and the correction pattern p2 in row (1) and column (iii) are printed by the nozzles a and b (4, 5) of the head 1 (K) of the first head group 34-1 and the nozzles n-1 and n (393, 394) of the head 7 (M) of the second head group 34-2.

In step S15, it is determined whether n≦m. In the example of FIG. 17, m=400.

In step S16, n is incremented by one. As a result, in the next loop of steps S11 through S14, the nozzles n-1 and n are shifted by one nozzle to the nozzles 394 and 395 (row (2)).

In step S17, the sheet is transported by a predetermined amount in the printing medium transport direction S1, and then the routine returns to step S11.

Thus, the process of incrementing n (S16), transporting the sheet by a predetermined amount in the printing medium transport direction S1 (S17), and then printing the (K) reference patterns p1 and the correction patterns p2 of the various colors (K, Y, C, M) (S11 through S14) is repeated until n is 400. As a result, the correction chart 800 of the test patterns p1 and p2 illustrated in FIG. 17 is obtained.

The correction chart 800 illustrated in FIG. 17 is similar to the correction chart 800 of FIG. 10 with the exception that in the case of FIG. 17, the column (iv) of the correction patterns p2 of black (K) is not omitted but printed in the correction chart 800. Namely, the correction chart 800 of FIG. 17 is obtained when step S11 of the flowchart of FIG. 16 is not omitted.

Figure 18:
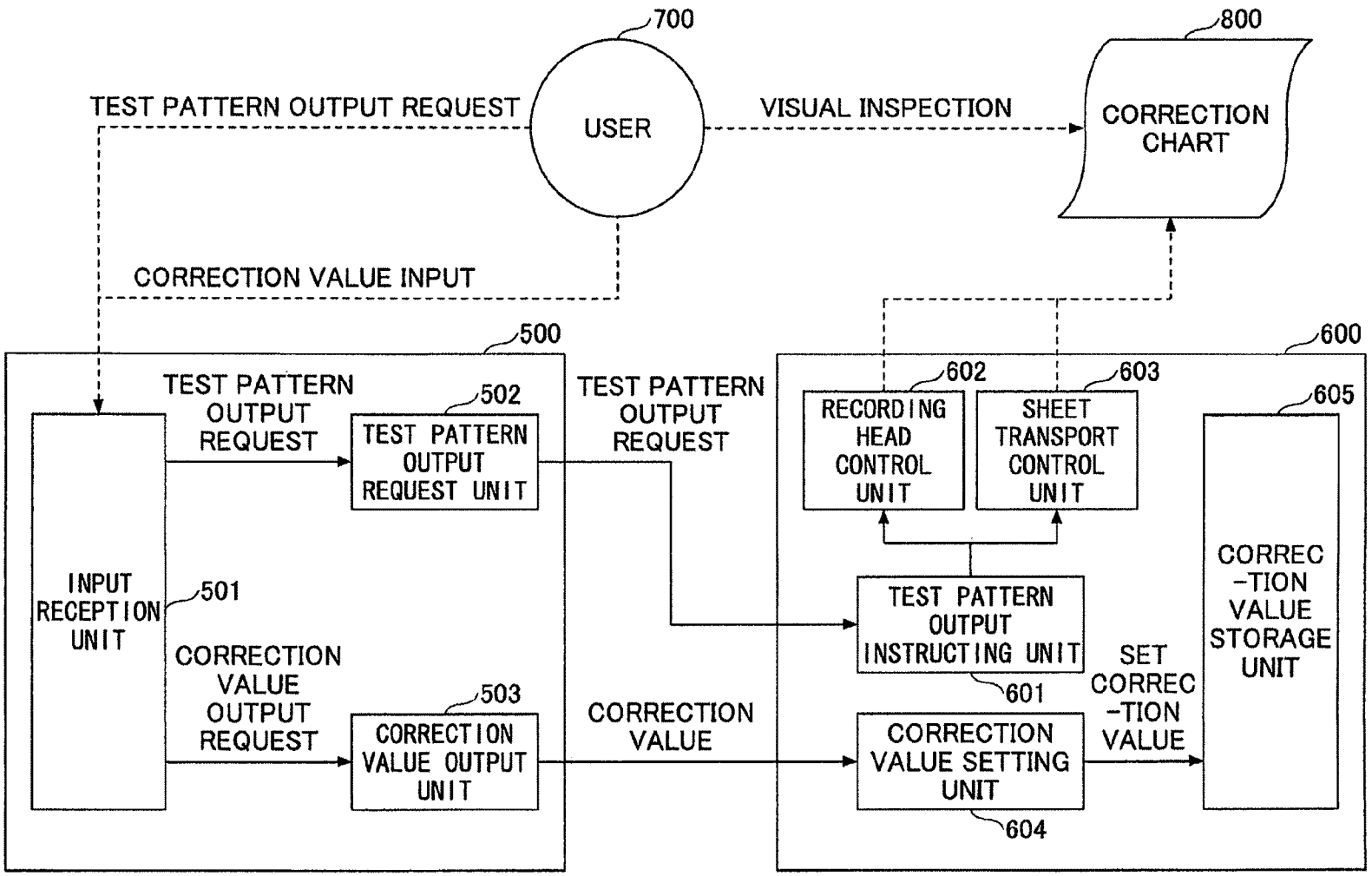
FIG. 18 is a functional block diagram of a system for performing a printing position error correcting method using a PC and an inkjet recording apparatus according to an embodiment of the present invention.

FIG. 18 illustrates a functional block diagram of the PC 500 and the recording apparatus 600. The PC 500 includes an input receiving unit 501 configured to receive an input from the user 700; a test pattern output request unit 502 configured to instruct the recording apparatus 600 to output the test patterns p1 and p2 in response to a test pattern output request from the user 700; and a correction value output unit 503 configured to output a correction value to the recording apparatus 600 in response to the input of the correction value from the user 700. The input receiving unit 501, the test pattern output request unit 502, and the correction value output unit 503 may be realized when a program loaded into a memory (not illustrated) is executed by a CPU (not illustrated) of the PC 500.

The recording apparatus 600 includes a test pattern output instructing unit 601; a recording head control unit 602; and a sheet transport control unit 603. The test pattern output instructing unit 601 is configured to control the recording head control unit 602 and the sheet transport control unit 603 so as to cause the printing of the correction chart 800 upon instruction from the PC 500. The recording head control unit 602 is configured to control the recording heads 34-1 and 34-2 under the control of the test pattern output instructing unit 601 so as to control the printing of the reference pattern p1 and the correction pattern p2 via the recording head driver 111 (see FIG. 8). The sheet transport control unit 603 is configured to control the sheet transport unit 112 under the control of the test pattern output instructing unit 601 so as to control, via the sub-scan driver 113, the transport of the sheet on which the reference pattern p1 and the correction pattern p2 are printed.

The recording apparatus 600 further includes a correction value setting unit 604 for setting the correction value input from the PC 500 in the correction value storage unit 605; and the correction value storage unit 605 for storing the correction value set by the correction value setting unit 604. The test pattern output instructing unit 601, the recording head control unit 602, the sheet transport control unit 603, and the correction value setting unit 604 may be realized when a program loaded into the RAM 119 is executed by the CPU 107 illustrated in FIG. 8. The correction value storage unit 605 may be realized by the RAM 119.

In the recording apparatus 600, when a correction value is set in the correction value storage unit 605, which of the nozzles of the first and the second head groups 34-1 and 34-2 should be used is determined based on the correction value, as described above. As a result, no position error is caused between the first and the second head groups 34-1 and 34-2, so that the image break or the density irregularities in a printed image due to the position error can be prevented.

Operation and Effect of the Recording Apparatus

As described above, in accordance with the present embodiment, the recording apparatus 600 is configured to form the correction chart 800. In the correction chart 800, the first test patterns p1 (reference patterns) are printed by the first head group 34-1 (reference head) and the second test patterns (correction patterns) p2 are printed by the second head group 34-2 (correction head) such that the relative positions of the first patterns (reference pattern) p1 and the second patterns (correction pattern) p2 is successively shifted in the sub-scan directions S1 and S2. The user 700 then observes the correction chart 800 and selects the test patterns p1 and p2 having the most closely aligned print positions in the sub-scan directions S1 and S2 between the recording heads 34-1 and 34-2 disposed in a staggered manner.

The user 700 then sets information (correction value) indicating the selected test patterns p1 and p2 in the recording apparatus 600. Thus, the recording apparatus 600 uses the nozzles used for printing the selected test patterns p1 and p2 as the corresponding nozzles of the recording heads 34-1 and 34-2 for printing dots. In this way, even when the recording heads 34-1 and 34-2 are disposed in a staggered manner, a printing position error in the sub-scan directions S1 and S2 due to the recording heads 34-1 and 34-2 can be minimized.

Although this invention has been described in detail with reference to certain embodiments, variations and modifications exist within the scope and spirit of the invention as described and defined in the following claims. For example, the printing position error control process according to the present embodiment is not limited to the four colors of black (K), cyan (C), magenta (M), and yellow (Y).

In the foregoing embodiment, the normal (ideal) position is where the upper eight nozzles of the first head group 34-1 are aligned with the lower eight nozzles of the second head group 34-2 in the sub-scan directions S1 and S2. However, the number of the nozzles aligned in the sub-scan directions S1 and S2 may be more than eight. Thus, it is also possible to form one or more additional rows of the test patterns p1 and p2 other than the seven rows (1) through (7) of the test patterns p1 and p2 illustrated in FIG. 11, so that more than three lines of printing position error may be recognized.

In the foregoing embodiment, the seven rows (1) through (7) of the test patterns p1 and p2 are printed while the printed position of the correction patterns p2 is shifted by one dot from one row to another. However, it is also possible to print the test patterns p1 and p2 while the printed position of the correction pattern p2 is shifted by two dots from one row to another.

The various units of the recording apparatus 600 according to the foregoing embodiment of the present invention may be controlled by hardware or software, or both. When software is used for controlling the various units of the recording apparatus, a program encoding a relevant process sequence may be installed in a memory of the PC 500 embedded in dedicated hardware and then executed.

For example, the program may be recorded in a recording medium such as a hard disk or a ROM (read only memory). The program may also be stored (recorded) in a removable recording medium temporarily or permanently. Such a removable recording medium may be provided as so-called package software. Examples of the removable recording media include a flexible disc, a CD-ROM (Compact Disc Read Only Memory), a MO (magneto-optical) disc, a DVD (digital versatile disc), a magnetic disc, and a semiconductor memory. The program may be installed from the aforementioned removable recording medium into the PC 500, or downloaded from a Web site to the PC 500 in a wireless or wired manner via a network, such as the Internet.

The processes performed by the recording apparatus 600 according to the various embodiments of the present invention may be performed sequentially or in parallel, depending on the capability of the processing apparatus.

The present application is based on Japanese Priority Applications No. 2009-163813 filed Jul. 10, 2009 and No. 2010-140739 filed Jun. 21, 2010, the entire contents of which are hereby incorporated by reference.

What is claimed is:

1. A recording apparatus comprising:

a carriage;

a first head group including a recording head and disposed on the carriage;

a second head group including a recording head and disposed on the carriage adjacent the first head group in a staggered manner with respect to a sub-scan direction, wherein the carriage is configured to move in a main scan direction in order to record an image on a recording medium;

a forming unit configured to cause the first head group to form a first pattern and the second head group to form a second pattern on the recording medium, wherein plural pairs of the first and the second patterns are successively formed spaced apart from each other in the sub-scan direction, and wherein a position of the second pattern relative to a position of the first pattern in the sub-scan direction is varied successively from one pair of the first and the second patterns to another; and an adjusting unit configured to adjust a positional relationship between a print position of the recording head of the first head group and a print position of the recording head of the second head group in the sub-scan direction based on a positional relationship between the first and the second patterns.

2. The recording apparatus according to claim 1, wherein the forming unit is configured to cause the first head group to form plural of the first patterns successively at equal intervals in the sub-scan direction, and the second head group to form plural of the second patterns such that the position of the second pattern relative to the position of the first pattern in the sub-scan direction is successively varied from one pair of the first and the second patterns to another.

3. The recording apparatus according to claim 1, wherein a first pair of the first and the second patterns is formed, and then a second pair of the first and the second patterns is formed spaced apart from the first pair by a predetermined interval in the sub-scan direction, wherein a positional relationship between the first and the second patterns of the first pair in the sub-scan direction is different from a positional relationship between the first and the second patterns of the second pair in the sub-scan direction.

4. The recording apparatus according to claim 1, wherein the adjusting unit is configured to adjust the positional relationship between the print position of the recording head of the first head group and the print position of the recording head of the second head group based on an apparent width of one of the pairs of the first and the second patterns in the sub-scan direction.

5. The recording apparatus according to claim 1, wherein the adjusting unit is configured to adjust the positional relationship between the print position of the recording head of the first head group and the print position of the recording head of the second head group based on an apparent color of one of the pairs of the first and the second patterns.

6. The recording apparatus according to claim 2, wherein the first patterns are formed using a predetermined nozzle of the recording head of the first head group, and the second patterns are formed using a different nozzle of the recording head of the second head group each time the position of the second pattern relative to the position of the first pattern is varied.

7. The recording apparatus according to claim 3, wherein the positional relationship between the first and the second patterns of the second pair in the sub-scan direction is made different from the positional relationship between the first and the second patterns of the first pair in the sub-scan direction by using different nozzles of the recording head of the second head group.

8. The recording apparatus according to claim 6, wherein the second patterns are printed using some of the nozzles of the second head group that have the same position in the sub-scan direction as the nozzles of the recording head of the first head group that are used for printing the first patterns.

9. A non-transitory computer-readable recording medium storing a recording program which, when executed by a computer, causes a recording apparatus including a first head group and a second head group disposed on a carriage in a staggered manner with respect to a sub-scan direction to perform the steps of:

causing a recording head of the first head group of the recording apparatus to form a first pattern on a recording medium;

causing a recording head of the second head group to form a second pattern on the recording medium at a position spaced apart from the first pattern in the sub-scan direction;

forming plural pairs of the first pattern and the second pattern at intervals on the recording medium in the sub-scan direction;

varying the position of the second pattern relative to a position of the first pattern from one pair of the first and the second patterns to another in the sub-scan direction; and adjusting a positional relationship between a print position of the recording head of the first head group and a print position of the recording head of the second head group in the sub-scan direction based on a positional relationship between the first and the second patterns.

* * * * *

UNITED STATES PATENT AND TRADEMARK OFFICE

CERTIFICATE OF CORRECTION

PATENT NO. : 8,215,743 B2
APPLICATION NO. : 12/805076
DATED : July 10, 2012
INVENTOR(S) : Kazushi Takei et al.

It is certified that error appears in the above-identified patent and that said Letters Patent is hereby corrected as shown below:

On the Title Page Item (73) Assignee: should read, Ricoh Company, Ltd., Tokyo (JP)

Signed and Sealed this
Twenty-third Day of April, 2013

Teresa Stanek Rea
*Acting Director of the United States Patent and Trademark Office*